US007448692B2

(12) United States Patent
Drake et al.

(10) Patent No.: US 7,448,692 B2
(45) Date of Patent: Nov. 11, 2008

(54) METHOD AND MEANS FOR PROCESSING OIL SANDS WHILE EXCAVATING

(75) Inventors: Ronald D. Drake, Arroyo Grande, CA (US); Michael Helmut Kobler, Sebastopol, CA (US); John David Watson, Evergreen, CO (US)

(73) Assignee: OSUM Oil Sands.Corp (CA)

( * ) Notice: Subject to any disclaimer, the term of this patent is extended or adjusted under 35 U.S.C. 154(b) by 126 days.

(21) Appl. No.: 11/005,759

(22) Filed: Dec. 6, 2004

(65) Prior Publication Data

US 2005/0093361 A1 May 5, 2005

Related U.S. Application Data

(62) Division of application No. 10/339,940, filed on Jan. 9, 2003, now Pat. No. 7,097,255.

(60) Provisional application No. 60/347,348, filed on Jan. 9, 2002, provisional application No. 60/424,540, filed on Nov. 6, 2002.

(51) Int. Cl.
*E21C 41/24* (2006.01)

(52) U.S. Cl. ..... 299/8; 299/55

(58) Field of Classification Search ..... 299/7, 299/8, 55, 56, 58

See application file for complete search history.

(56) References Cited

U.S. PATENT DOCUMENTS

| | | | | |
|---|---|---|---|---|
| 604,330 | A | 5/1898 | Kibling | |
| 3,034,773 | A | 5/1962 | Legatski | |
| 3,678,694 | A | 7/1972 | Hapert | |
| 3,778,107 | A | 12/1973 | Haspert | |
| 3,784,257 | A | 1/1974 | Lauber et al. | |
| 3,888,543 | A | 6/1975 | Johns | |
| 3,941,423 | A * | 3/1976 | Garte | 299/8 |
| 3,960,408 | A | 6/1976 | Johns | |
| 4,055,959 | A | 11/1977 | Fritz | |
| 4,067,616 | A | 1/1978 | Smith et al. | |
| 4,072,018 | A | 2/1978 | Alvarez-Calderon | |
| 4,099,388 | A | 7/1978 | Hüsemann et al. | |
| 4,116,487 | A * | 9/1978 | Yamazaki et al. | 299/1.9 |
| 4,152,027 | A | 5/1979 | Fujimoto et al. | |
| 4,167,290 | A | 9/1979 | Yamazaki et al. | |
| 4,203,626 | A | 5/1980 | Hamburger | |
| 4,209,268 | A | 6/1980 | Fujiwara et al. | |
| 4,216,999 | A | 8/1980 | Hanson | |
| 4,440,449 | A | 4/1984 | Sweeney | |

(Continued)

FOREIGN PATENT DOCUMENTS

CA 986146 3/1976

(Continued)

OTHER PUBLICATIONS

Loval Inc. Company Brochure.

(Continued)

*Primary Examiner*—John Kreck
(74) *Attorney, Agent, or Firm*—Sheridan Ross P.C.

(57) ABSTRACT

The present invention is directed to the separation of bitumen, such as by the Clark process or by a countercurrent de-sander, in an underground excavation machine, such as a tunnel boring machine.

26 Claims, 19 Drawing Sheets

U.S. PATENT DOCUMENTS

| | | | | |
|---|---|---|---|---|
| 4,445,723 | A | 5/1984 | McQuade | |
| 4,455,216 | A | 6/1984 | Angevine et al. | |
| 4,456,305 | A * | 6/1984 | Yoshikawa | 299/33 |
| 4,458,947 | A | 7/1984 | Hopley et al. | |
| 4,486,050 | A | 12/1984 | Snyder | |
| 4,494,799 | A | 1/1985 | Snyder | |
| 4,505,516 | A | 3/1985 | Shelton | |
| 4,603,909 | A | 8/1986 | Le Jeune | |
| 4,607,889 | A | 8/1986 | Hagimoto et al. | |
| 4,699,709 | A | 10/1987 | Peck | |
| 4,774,470 | A | 9/1988 | Takigawa et al. | |
| 4,793,736 | A | 12/1988 | Thompson et al. | |
| 4,808,030 | A | 2/1989 | Takegawa | |
| 4,856,936 | A | 8/1989 | Hentschel et al. | |
| 4,911,578 | A | 3/1990 | Babendererde | |
| 4,946,597 | A | 8/1990 | Sury | |
| 5,032,039 | A | 7/1991 | Hagimoto et al. | |
| 5,051,033 | A | 9/1991 | Grotenhofer | |
| 5,125,719 | A | 6/1992 | Snyder | |
| 5,141,363 | A | 8/1992 | Stephens | |
| 5,174,683 | A | 12/1992 | Grandori | |
| 5,205,613 | A | 4/1993 | Brown, Jr. | |
| 5,211,510 | A | 5/1993 | Kimura et al. | |
| 5,316,664 | A | 5/1994 | Gregoli et al. | |
| 5,330,292 | A | 7/1994 | Sakanishi et al. | |
| 5,534,136 | A | 7/1996 | Rosenbloom | |
| 5,534,137 | A | 7/1996 | Rosenbloom | |
| 5,697,676 | A | 12/1997 | Kashima et al. | |
| 5,831,934 | A | 11/1998 | Gill et al. | |
| 5,852,262 | A | 12/1998 | Gill et al. | |
| 5,879,057 | A | 3/1999 | Schwoebel et al. | |
| 5,890,771 | A | 4/1999 | Cass | |
| 6,003,953 | A | 12/1999 | Huang et al. | |
| 6,017,095 | A | 1/2000 | DiMillo | |
| 6,027,175 | A | 2/2000 | Seear et al. | |
| 6,206,478 | B1 | 3/2001 | Uehara et al. | |
| 6,554,368 | B2 | 4/2003 | Drake et al. | |
| 2003/0038526 | A1 | 2/2003 | Drake et al. | |
| 2003/0160500 | A1 | 8/2003 | Drake et al. | |

FOREIGN PATENT DOCUMENTS

| | | |
|---|---|---|
| CA | 986544 | 3/1976 |
| CA | 1165712 | 4/1984 |
| CA | 1167238 | 5/1984 |
| CA | 2124199 | 11/1991 |
| CA | 2222668 | 11/1997 |
| CA | 2315596 | 5/2000 |
| CA | 2332207 | 1/2001 |
| CA | 2358805 | 1/2001 |
| WO | 01/69042 A1 | 9/2001 |

OTHER PUBLICATIONS

Babendererde et al., "Extruded Concrete Lining—The Future Lining Technology for Industrialized Tunnelling," 2001 RETC Proceedings, Chapter 55, pp. 679-685.

Becker, C., "The Choice Between EPB- and Slurry Shields: Selection Criteria by Practical Examples," 1995 RETC Proceedings, Chapter 31, pp. 479-492.

Becker, C., "Recent Application of Slurry- and EPB-Technique in Europe," 1999 RETC Proceedings, Chapter 48, pp. 857-864.

Becker, C., The Fourth Tube of the Elbe-Tunnel—Built by the World's Largest Soft Ground Tunnelling Machine, 2001 RETC Proceedings, Chapter 17, pp. 182-186.

Bergling et al., "Main Bearings for Advanced TBMS," 1995 RETC Proceedings, Chapter 32, pp. 493-508.

Borm, G., "Intergrated Seismic Imaging System for Geological Prediction Ahead in Underground Construction," 2001 RETC Proceedings, Chapter 22, pp. 263-271.

Canadian Heavy Oil Associate (CHOA) Annual Conference, Dec. 6, 2000, presentation by Oil Sands Underground Mining, Inc.

Corti et al., "Alhabasca Mineable Oil Sands: The RTR/Gulf Extraction Process Theoretical Model of Bitumen Detachment," The 4th UNITAR/UNDP International Conference on Heavy Crude and Tar Sands Proceedings, vol. 5, Edmonton, AB, Aug. 7-12, 1988, pp. 41-44, 71.

Downden et al., "Coping with Boulders in Soft Ground TBM Tunneling." 2001 RETC Proceedings, Chapter 78, pp. 961-977.

Doyle et al., "Construction of Tunnels in Methane Environments," 1991 RETC Proceedings, Chapter 12, pp. 199-224.

Drake, R., "An Innovative Approach for the Underground Mining of Oil Sands," presented at North American Tunneling 2002, Seattle, WA May 2002 and NARMS-TAC 202, Mining and Tunneling Innovation and Opportunity Conference, Toronto, Ontario, Jul. 2002, 8 pages.

Drake et al., "A Promising New Concept for Underground Mining of Oil Sands," technical papers presented to Canadian Institute of Mining (CIM), Ft. McMurray, Jun. 13-15, 2001, pp. 1-16.

Friesen et al., "Monitoring of Oil Sand Slurries by On-line NIR Spectroscopy"; Petroleum Society of CIM & Aostra; paper No. 94.10; 9 pages.

Funasaki et al., "World's Largest Slurry Shield Tunneling Report on Trans-Tokyo Bay Highway Construction,"1997 RETC Proceedings, Chapter 36, pp. 591-604.

Guetler et al., "Two Tunnels in Totally Different Geological Formations Driven by the Same 7M Double-Shiels TMB with an Extremely Thin-Walled Monoshell Honeycomb Segmental Lining Sytem," 2001 RETC Proceedings, Chapter 21, pp. 241-260.

Harris et al.; "FeasibilityStudy of Underground Mining of Oil Sand"; AOSTRA Seminar on Underground excavation in Oil Sands; May 19, 1978; 33 pages.

Herrenknecht et al., "The New Generation of Soft Ground Tunnelling Machines," 1999 RETC Proceedings, Chapter 36, pp. 647-663.

Higashide et al., "Application of DOT Tunneling Method to Construction of Multi-Service Utility Tunnel Adjacent to Important Structures," 1995 RETC Proceedings, Chapter 34, pp. 527-541.

Hignett et al,; "Tunnelling Trials in Chalk: Rock Cutting Experiments": *TRRL Laboratory Report 796*; 1977.

Hunter et al.; "Design, development, and verification of a Lovat 7.6-metre full-face tunnel-boring machine": *CIM Coal Developments*; 8 pages.

"In Focus: Sunburst Excavation," *World Mining Equipment*, Nov. 1993, pp. 18-19, 22-23.

"Improving Profitability With New Technlogy," Joint Paper Between Petrel Robertson and Oil Sands Underground Mining, Inc., Edmonton, Alberta, Sep. 2001, 44 pages.

Jacobs et al., "Hydrogen Sulfide Controls for Slurry Shield Tunneling in Gassy Ground Conditions—A Case History," 1999 RETC Proceedings, pp. 221-239.

"Canadian Coal Given the TBM Treatment at Cape Breton"; Reprinted from *Tunnels & Tunnelling*, May 1985; 4 pgs.

Liu et al.; "Volume reduction of oil sands fine tails utilizing nonsegregating tailings"; *Tailings and Mine Waste* '96; pp. 73-81.

Maciejewski; "Hydrotransport—An Enabling Technology for Future Oil Sands Development"; Syncrude Canada Ltd.; pp. 67-79.

Marcheselli et al., "Construction of the 'Passante Ferroviario' Link in Milano, Lots 3P—5P—6P Excavation by Large Earth Pressure Ballanced Shield with Chemican Foam Injection," 1995 RETC Proceedings, Chapter 36, pp. 549-572.

Marsh et al.; "Design, Excavation, Support of a Large Diameter Coal Mine Access Decline Using a Tunnel Boring Machine"; Chapter 11: *RETC Proceedings*, vol. 1: pp. 155-176.

Matthews et al.; "Development of composite tailings technology at Syncrude Canada"; Syncrude EDM Research; 2000; pp. 455-463.

McCormick et al.; Analysis of TBM Performance at the Record Setting River Mountains Tunnel #2; Chapter 8: 1997 *RETC Proceedings*; pp. 135-149.

Mikula et al.; "Oil Sands Conditioning, Biyumen Release Mechanisms, and New Process Development": Alberta Oil Sands Information Services; 1993; 8 pgs.

Mikula et al., "Commercial Implementation of a Dry Landscape Oil Sands Tailings Reclamation Option: Consolidated Tailings"; Alberta Oil Sands Information Services; No. 1998.096; pp. 907-921.

Mitsubishi Shield Machine Article; by Mitsubishi Heavy Industries, Ltd.; 33 pages.
Moulton et al., "Tunnel Boring Machine Concept for Converging Ground," 1995 RETC Proceedings, Chapter 33, pp. 509-523.
Oil Sands Underground Mining, Inc., "Underground Mining of Oil Sands," presented at National Oil Sands Task Force, Jan. 2001 Quarterly Meeting, 38 pages.
Oil Sands Underground Mining, Inc., "A New Technology for the Recovery of Oil Sands,"presented at combined Oil Sands Task Force and Black Oil Pipeline Network Meeting, Jun. 2001, 30 pages.
Oil Sands Underground Mining, Inc., "A Private Sector Approach to Design/Build,"presented at NAT 2002, 34 pages.
Ounanian et al., "Development of an Extruded Tunnel Lining System" Chapter 81; 1981 *RETC Proceedings* vol. 2; pp. 1333-1351.
Ozdemir et al., Development of a Water Jet Assisted Drag Bit cutting Head for Coal Measure Rock, 1983 RETC Proceedings, Chapter 41, vol. 2, pp. 701-718.
Paine et al., "Understanding Hydrotransport: The Key to Syncrude's Success," *CIM Bulletin*; vol. 92; 1999; pp. 105-108.
Peer; "Gaint Rock TBM to Drive Access Tunnels Under Ocean," reprinted from *Heavy Construction News*; Sep. 19, 1983; 2 pgs.
Richards et al., "Slurry Shield Tunnels on the Cairo Metro," 1997 RETC Proceedings, Chapter 44, pp. 709-733.
Rose, D., "Steel-Fiber-Reinforced-Shotcrete for Tunnels: An International Update," 1999 RETC Proceedings, pp. 525-536.
Sager, H., "Underpassing the Westerschelde by Implementing New Technologies," 1999 RETC Proceedings, pp. 927-938.
Stack, Barbara; *Handbook of Mining and Tunnelling Machinery* (John Wiley & Sons 1982), pp. 283, 311.
Stokes et al.; "Cutting head ventilation of a full face tunnel boring machine"; Cape Breton Coal Research Laboratory, CANMET, Sydney, Canada; pp. 305-311.
Uchiyama, S., "Twin TBM with Four Cutters for Subway Station (Roppongi Station in the Tokyo Metro Line 12)," 1999 RETC Proceedings, Chapter 37, pp. 665-674.
Wang et al., "High Pressure Water Jet Assisted Tunnelling," 1976 RETC Proceedings, Chapter 34, pp. 649-676.
Wu et al., "Stress Analysis and Design of Tunnel Linings," Chapter 26, pp. 431-455.
Yoshidawa et al.; "A Study of Shield Tunnelling Machine (Part 1)—Solid Condition for Pressurized Slurry Shield to be Adapted-"; Translation Copy of Hitachi Zosen Technical Review; vol. 42; No. 1-4; 1981; 38 pages.
Young et al., "Full-scale Testing of the PCF. Rock Excavation Method"; *VIII Australian Tunnelling Conference*; Sydney, Aug. 24-26, 1993, pp. 259-264.
Press Release; Slurries.wpd; Jan Czarnecki; 3 pages.
Official Action for U.S. Appl. No. 11/558,335, mailed Oct. 3, 2007.
International Search Report for International (PCT) Patent Application No. PCT/US03/00656, mailed Aug. 29, 2003.
Schenck "Recent Developments in High-Pressure Water-Jet Assisten Cutting of Rock and Coal", The Pennsylvania State University, RETC Proceedings, vol. 2, Chapter 39, 1983 p. 663-684.
Zink et al., "Water Jet Uses in Sandstone Excavation", RETC Proceedings, vol. 2, Chapter 40, 1983 p. 685-700.
Souder et al. "Water Jet Coal Cutting: The Resurgence Of An Old Technology", RETC Proceedings, vol. 2, Chapter 42, 1983 p. 719-739.
Notice of Allowance for U.S. Appl. No. 11/558,335, mailed Aug. 7, 2008.

* cited by examiner

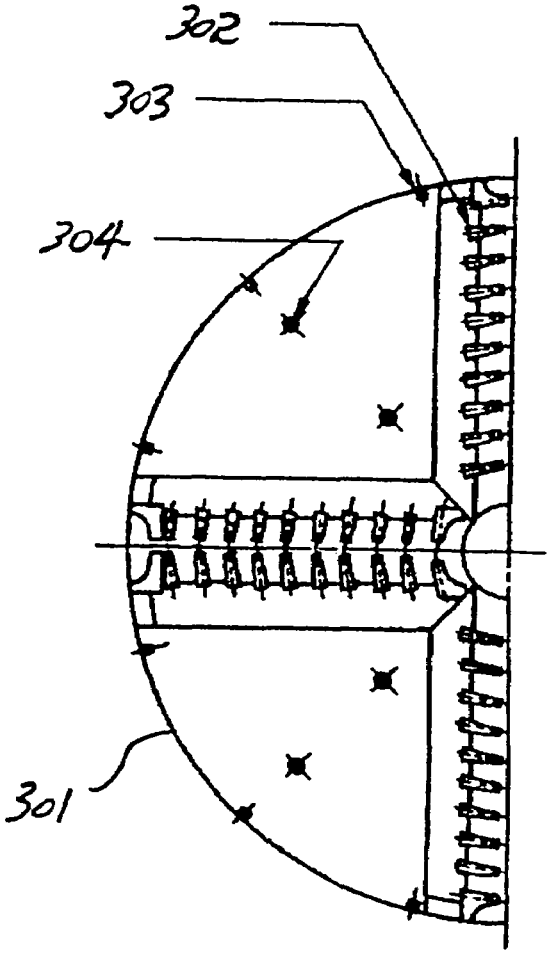
FIG 3a
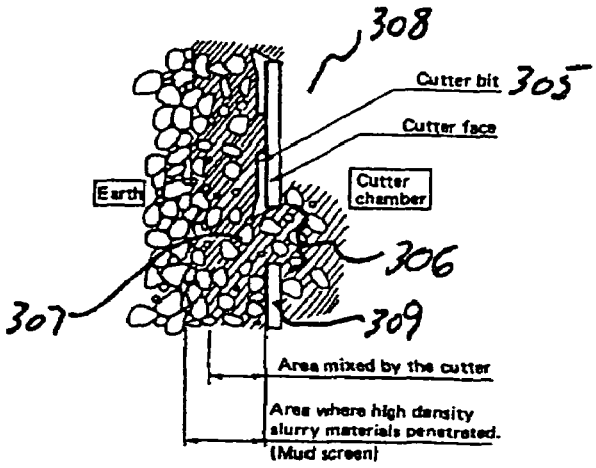
FIG 3b
FIGURE 3

Basic Structure of High Density Slurry Shield Machine

METHOD AND MEANS FOR PROCESSING OIL SANDS WHILE EXCAVATING

CROSS REFERENCE TO RELATED APPLICATIONS

The present invention is a divisional patent application of U.S. patent application Ser. No. 10/339,940 filed Jan. 9,2003 now U.S. Pat. No. 7,097,255, of the same title and inventors, which claims the benefits of U.S. Provisional Applications Ser. Nos. 60/347,348, filed Jan. 9, 2002, and 60/424,540, filed Nov. 6, 2002, each of which is incorporated herein by reference in its entirety.

FIELD OF THE INVENTION

The present invention is related generally to extracting bitumen from excavated oil sands and particularly to extracting the bitumen from the excavated oil sands in a shielded underground mining machine.

BACKGROUND OF THE INVENTION

There are substantial deposits of oil sands in the world with particularly large deposits in Canada and Venezuela. For example, the Athabasca oil sands region of the Western Canadian Sedimentary Basin contains an estimated 1.3 trillion barrels of potentially recoverable bitumen. There are lesser, but significant deposits, found in the U.S. and other countries. These oil sands contain a petroleum substance called bitumen (similar to an asphalt) or heavy oil (a highly viscous form of crude oil). Oil Sands deposits cannot be economically exploited by traditional oil well technology because the bitumen or heavy oil is too viscous to flow at natural reservoir temperatures.

Often the oil sands deposits may be tilted such that some of the resource will be found near the surface but much of the resource will occur at ever greater depths of burial. This is the case, for example, in the Athabasca oil sands of Alberta, Canada.

When oil sand deposits are at or near the surface, they can be economically recovered by surface mining methods. Recovery by surface mining is economical when there is, at most, a relatively thin layer of overburden that can be removed by large surface excavation machines. In current state-of-the-art oil sands surface mines, the exposed oil sands are excavated directly by large power shovels, transported by large haulage trucks to a conversion facility called a cyclofeeder. The ore is crushed and turned into a slurry in the cyclofeeder. From there, the slurry is hydrotransported to a large extraction facility where the bitumen is separated from the ore. The bitumen recovered from the extraction process is then transported to an upgrader facility where it is refined and converted into crude oil and other petroleum products.

The Canadian oil sands surface mining community is evaluating machines that can excavate material at an open face and process the excavated oil sands directly into a slurry. If such machines are successful, they could replace the shovels and trucks and cyclofeeder facility currently used, by producing an oil sands slurry at the working face which could then be sent via a hydrotransport system to a bitumen extraction facility.

In the large surface mining process described above, there is substantial disturbance of the surface. In Canada especially, the disturbed surface must be returned to its original condition after the recovery operations are complete. This requirement adds significantly to overall bitumen recovery costs. In the large surface mines, excavating the material and extracting the bitumen contribute significant emissions (principally carbon dioxide and methane) to the atmosphere.

When oil sand deposits are too far below the surface for economic recovery by surface mining, bitumen can be economically recovered in many areas by recently developed in-situ recovery methods such as SAGD (Steam Assisted Gravity Drain) or other variants of gravity drain technology which can mobilize the bitumen or heavy oil. The in-situ methods require a certain level of overburden for the process to be contained and also require deposits of a certain minimum thickness (typically greater than about 20 meters). The recovery factor of the in-situ methods can be degraded by the presence of intervening mud and shale layers within the deposits which can form barriers to the outward flow of steam and return flow of mobilized bitumen or heavy oil. Thus the economics of these processes are sensitive to the complex and variable natures of the reservoir geologies that are found. In the SAGD method, horizontal drilling technology is used to drill two closely spaced horizontal wells near the bottom of the ore deposits. These well pairs are used to inject steam into the formation above to heat and mobilize the bitumen. The heated bitumen then flows downward by gravity and is collected in one of the horizontal wells and pumped to the surface. The bitumen is then processed and sent to an upgrader facility.

SAGD requires enormous amounts of energy to generate steam to heat the underground deposits to the point where the bitumen can flow and be pumped. Typically, 20% to 30% of the energy recovered from a barrel of bitumen must be used to produce the steam required to recover the next barrel of bitumen in the SAGD process. The production of energy to produce steam also contributes significantly to greenhouse gas emissions.

Roughly 65% (approximately 845 billion barrels) or most of the deposits in the Athabasca cannot be recovered by either surface mining or in-situ technologies. There is a considerable portion of oil sands deposits that are in "no man's land". These are areas where either (1) the overburden is too thick and/or there is too much water-laden muskeg for economical recovery by surface mining operations; (2) the oil sands deposits are too shallow for SAGD and other thermal in-situ recovery processes to be applied effectively; or (3) the oil sands deposits are too thin (typically less than 20 meters thick) for efficient use of surface mining or in-situ methods. This "no man's" land also includes significant deposits within the surface mineable areas that are under too much overburden, under swamps or under large tailings ponds. These "no man's" land deposits within the surface mineable areas are significant and contain tens of billions of barrels of economic grade bitumen. There is currently no viable means to recover the bitumen or heavy oil from these "no man's" land areas. Estimates for economical grade bitumen in these "no man's" land areas range from 30 to 100 billion barrels.

These "no man's" land deposits can be exploited by an appropriate underground mining technology. One such underground mining technique is the use of large soft-ground tunneling machines which are designed to backfill most of the tailings behind the advancing machine. This concept is described in U.S. patent application Ser. No. 09/797,886, filed Mar. 5, 2002, and entitled "Method and System for Mining Hydrocarbon-Containing Materials", which is incorporated herein by this reference, By this method, an ore slurry, such as produced by the cyclofeeder facility of a surface mine, or a bitumen froth, such as produced by a SAGD operation, can be outputted by the backfiling Tunnel Boring Machine or TBM, depending on whether any substantial ore processing is done inside the TBM. The material used for backfilling most of the volume excavated is provided by processed spoil or tailings from which the hydrocarbon or valuable ore has been extracted.

One embodiment of the mining method envisioned by U.S. patent application Ser. No. 09/797,886 involves the combination of slurry TBM excavation techniques with hydrotransport haulage systems as developed by the oil sands surface mining industry. A TBM operated in slurry mode can be designed to produce an oil sands-slurry compatible with the density requirements of an oil sands hydrotransport system. Such a system appears to be capable of efficiently excavating oil sands, transporting the oil sand slurry to the surface for processing and then hydrotransporting a tailings slurry back to the advancing TBM for use as backfill material. TBMs may also be operated in non-slurry or dry mode. When operated in dry cutting mode, the TBM may still be a fully shielded machine with full isolation of the excavated material from the manned interior of the TBM and its trailing tunnel liner. In another embodiment of the mining method envisioned by U.S. patent application Ser. No. 09/797,886, the bitumen may be separated inside the TBM or mining machine by any number of various extraction technologies.

The Athabasca oil sand is a dense interlocked skeleton of predominantly quartz sand grains with pore spaces occupied by bitumen, water, gas and minor amounts of clay. The sand grains are whetted by water and the bitumen does not directly contact the grains. The bitumen is a semi-solid hydrocarbon substance resembling asphalt. Because the bitumen is semi-solid and very viscous, it causes the oil sand to be relatively impermeable to the flow of free water and gas. Gas is present as discrete bubbles and also dissolved in both the bitumen and water.

For example, at 150 meters of overburden, it has been estimated that 0.3 to 0.6 cubic meters of gas is dissolved in a cubic meter of oil sand mined. This gas is typically composed of 80% methane and 20% carbon dioxide. When exposed to atmospheric pressure, the dissolved gas comes out of solution and can be released into the atmosphere, for example by surface mining. Methane is a powerful greenhouse gas which is estimated to be equivalent to 21 times its weight as-potent as carbon dioxide.

For the purposes of the present invention, the entities referred to variously as lumps, particles and matrices in the published art are referred to as granules, to distinguish them on one hand from sand grains or particles which they contain, and on the other hand from large lumps of oil sand as mined. Such granules include a nucleus of sand grains covered with a film of connate water, which may itself contain fine particles, encapsulated, often with gas inclusions, within a layer of the heavy oil known as bitumen, which is essentially solid at ground temperatures. The terms oil and bitumen are used interchangeably in this specification.

The process originally developed for releasing bitumen from oil sands was the Clark hot water process, based on the work of Dr. K. A. Clark, and discussed in a paper "Athabasca Mineable Oil Sands: The RTR/Gulf Extraction Process—Theoretical Model of Detachment" by Corti and Dente which is incorporated herein by reference.

Both the presently used commercial method and apparatus for the recovery of oil or bitumen from oil sands based on the Clark process, and the similar process and apparatus described in U.S. Pat. No. 4,946,597, use vigorous mechanical agitation of the oil sands with water and caustic alkali to disrupt the granules and form a slurry, after which the slurry is passed to a separation tank for the flotation of the bitumen from which the bitumen is skimmed. As proposed in the U.S. patent, the process may be operated at ambient temperatures, with a conditioning agent being added to the slurry. Earlier methods, such as the Clark process, used temperatures of 85° C. and above together with vigorous mechanical agitation and are highly energy inefficient. It is characteristic of both of the above processes that a great deal of mechanical energy is expended on physically disintegrating the oil sands structure and placing the resulting material in fluid suspension, this disintegration being followed by physical separation of the constituents of the suspension. Chemical adjuvants, particularly alkalis, are utilized to assist these processes. The separation process particularly is quite complex, as will be readily apparent from a study of U.S. Pat. No. 4,946,597, and certain phases have presented particularly intractable problems. Oil sands typically contain substantial but variable quantities of clay, and the very fine particles constituting this clay are dispersed during the process, limiting the degree to which the water utilized in the process can be recovered by flocculation of the clay particles. No economical means has been discovered of disposing of the flocculated and thickened clay particles, which form a sludge which must be stored in sludge ponds where it remains in a gel-like state indefinitely.

The Clark process has disadvantages, some of which are discussed in the introductory passage of U.S. Pat. No. 4,946,597 which is incorporated herein by reference, notably a requirement for a large net input of thermal and mechanical energy, complex procedures for separating the released oil, and the generation of large quantities of sludge requiring indefinite storage.

The Corti and Dente paper mentioned above suggests that better results should be obtained with a proper balance of mechanical action and heat application, and Canadian Patent No. 1,165,712, which is incorporated herein by reference, points out that more moderate mechanical action will reduce disaggregation of the clay content of the sands. Nevertheless, it continues to regard external mechanical action as playing an essential role in the disintegration of the oil and granules, which will inevitably result in partial dispersion of the clay. Thus, it proposes to use relatively more gentle agitation of the sand in a slowly rotating digester described in Canadian Patent No. 1,167,238 which is incorporated herein by reference. The digester in Canadian Patent No. 1,167,238 comprises in its broadest embodiment a shell, means for entry of liquids and solids into the shell at one end of the shell, a tubular outlet at the other end of the shell for discharge of liquids, a solids outlet at the same end as the liquids outlet, surrounding but separated from the liquids outlet, and a screw which surrounds the tubular liquids outlet to urge solids to and through the solids outlet, which screw is secured at its outer periphery to the shell. As seen in FIGS. 1, 2, 3 and 4 of Canadian Patent No. 1,167,238, the operating embodiment of the digester includes numerous plates and bars secured to the shell for moving the solids along the shell, and a set of bars for separating the clay from the oil sands. Slurry is introduced at one end of the shell. This slurry is a mixture of oil sands and hot water. The slurry is moved by the plates, bars and screw down the shell during which it is agitated and the oil and water gradually separated from the solids. At the other end of the shell, such oil and water, together with some fine material that has separated from the solids, is removed from one central, axial outlet, while the solids exit the digester at its base. This process, which is a concurrent process, still requires considerable post digestion treatment, as described in Canadian Patent No. 1,165,712 . The post digestion steps include further separation of the liquids into an oil rich component and a middlings component consisting primarily of water and fines, removing the fines from the middlings component by flocculation and centrifuging, and further treating the oil rich component for the removal of contained water, fines and solids. A detailed outline of the process is described with reference to FIG. 1 of Canadian Patent No. 1,165,712.

Separator cells, ablation drums, and huge interstage tanks are typical of apparatuses necessary in oil sands extraction. The one with perhaps the greatest potential is the Bitmin drum or Counter-Current De-Sander system or CCDS. Canadian Patent 2,124,199 provides a method of liberating and separating heavy oil or bitumen from oil sand in a counter current desanding apparatus known as a bitmin drum. The bitmin drum is a rotating vessel with various internal fins and pockets into which oil sand ore is fed at the upstream end and water is fed in at the downstream end. The outputs of the bitmin drum are a bitumen froth (bitumen, water and some sand and clay) slurry and a separate damp sand discharge.

Rather than seeking to find a balance of thermal and mechanical action to release the oil from the sand, Canadian Patent 2,124,199 relies mainly on thermal action alone to provide release or liberation of the bitumen. The presence of hot water acts as a medium both for heat transfer and for separation to occur. Mechanical action is used to ensure adequate contact between the water and the oil sand and its separated constituents so as to permit it to act effectively as both a heat transfer medium and a separation medium. The action of the bitmin drum is described in detail in Canadian Patent 2,124,199 and other references which are hereby incorporated by reference in the present invention.

The CCDS process is carried out in the bitmin drum, comprising submerging sand to be treated into a bath of hot water, gently rolling the sand within the bath. The resultant agitation of the water is sufficient to prevent liberated oil droplets from migrating to the surface of the bath, and the rolling of the sand is gentle enough to minimize substantial dispersion of any clay present. It is, however, sufficiently prolonged to permit substantial release and separation of oil coating from granules of the sand, removing sand from one end of the bath, and removing water, and oil from the other end of the bath. The sand and hot water are supplied at opposite ends of the bath to those at which they are removed. By passing the oil sand to be treated and the hot water in opposite directions through the bath, various advantages accrue. For example, separated oil froth passes with the water towards the opposite end of the bath from that at which the separated sand is removed, thus minimizing the risk of re-entrainment of oil on the sand as the latter is removed. The sand is exposed to the hottest water in the later stages of its treatment, thus favoring completion of liberation of the oil and the separation process. A settling zone maybe provided at the end of the bath from which the oil is removed, thus again favoring separation of the suspended solid particles from the water and oil before the latter leaves the bath.

An important objective of the CCDS process is to minimize the attrition of clay lumps in the oil sands with resultant suspension of clay solids in the treatment water. This is achieved by minimizng mechanical working of the oil sands during the release and separation process. The less clay is suspended, the easier is the treatment and recycling of the water used in the process, and the less clay sludge is produced requiring indefinite storage. An objective is to leave most of the clay essentially in its original state so that it may be returned, together with the separated sand, to the site from which the raw oil sands were extracted.

Other oil sands extraction methods include, but are not limited to, cyclo-separators in which centrifigal action is used to separate the low specific gravity materials (bitumen and water) from the higher specific gravity materials (sand, clays etc). The cyclo-separator has a number of major disadvantages including but not limited to (i) the need to comminute large rocks and remove contaminants, such as wood and tramp metal from input streams to avoid damaging the cyclo-separator; (ii) high rates of equipment wear and the concomittant need to use expensive abrasion resistant materials; (iii) de-aeration of the recovered bitumen which causes problems for downstream stages of separation; and (iv) cyclone failure or viscous plugging due to a black froth condition for high bitumen content ores. All studies to-date have led to the abandonment of the hydro-cyclone solution, even in very large fixed separation facilities.

The TCS process is a variant of the cyclone method, which involves three cyclones in a counter-current backwash configuration. The TSC circuit, as presently conceived, is a very large device because of the large front-end rougher separator cell which heads up that circuit.

Commercial surface mining operations in the oil sands require the excavation, haulage and processing of vast amounts of material. Once the bitumen has been extracted, the volume of tailings is actually greater than the original volume. This is because the bitumen originally resides in the pore space of interlocked sand grains. Even with the bitumen removed, the sand grains cannot be reconstituted into their original volume even under tremendous pressure. Thus, current surface mining methods result in a large and costly tailings disposal problem.

In a mining recovery operation, the most efficient way to process oil sands is therefore to excavate and process the ore as close to the excavation as possible. If this can be done using an underground mining technique, then the requirement to remove large tracts of overburden is eliminated. Further, the tailings can be placed directly back in the ground thereby eliminating a tailings disposal problem. The extraction process for removing the bitumen from the ore requires substantial energy. If a large portion of this energy can be utilized from the waste heat of the excavation process, then this results in less overall greenhouse emissions. In addition, if the ore is processed underground, methane liberated in the process can also be captured and not released as a greenhouse gas.

There is thus a need for a bitumen/heavy oil recovery method in oil sands that can be used to perform one or more of the following functions: (i) extend mining underground to substantially eliminate overburden removal costs; (ii) avoid the relatively uncontrollable separation of bitumen in hydrotransport systems; (iii) properly condition the oil sands for further processing underground, including crushing; (iv) separate most of the bitumen from the sands underground inside the excavating machine; (v) produce a bitumen slurry underground for hydrotransport to the surface; (vi) prepare waste material for direct backfill behind the mining machine so as to reduce the haulage of material and minimize the management of tailings and other waste materials; (vii) reduce the output of carbon dioxide and methane emissions released by the recovery of bitumen from the oil sands; and (viii) utilize as many of the existing and proven engineering and technical advances of the mining and civil excavation industries as possible.

SUMMARY OF THE INVENTION

These and other needs are addressed by the various embodiments and configurations of the present invention. The present invention is directed to hydrocarbon recovery in continuous excavation machines, such as a tunnel boring machine. As used herein, a "tunnel boring machine" refers to an underground excavating machine characterized by a rotating front end on which cutting tools are mounted and a cylindrical shield that forms the body of the machine. The rotating front end is connected to the shield, which does not rotate, by various shafts, rings and other structural members. As used in civil tunneling work, the machine moves through the ground that it excavates by propelling itself by gripping the walls of the excavation (hard rock TBMS) or by pushing off the tunnel liner being erected behind the machine (soft-ground TBMs). Multi-headed TBMs may be constructed by connecting one or more cylindrical TBMs.

In one embodiment, hydrocarbon-containing materials (e.g., oil sands) are conditioned and the hydrocarbon component (e.g., bitumen) in the materials separated as part of the action of excavating the oil sands by a shielded mining machine. The mining machine can include the following components:

(i) a rotatable cutter head operable to excavate hydrocarbon-containing material;

(ii) a body engaging the cutter head; and (iii) a vessel operable to separate a hydrocarbon-containing component of the hydrocarbon-containing material from a waste component of the hydrocarbon-containing material. At least part of the vessel is operatively engaged with the cutter head to rotate in response to cutter head rotation. As used herein, a "cutter head" refers to the rotating cutting device located at the front end of the tunnel boring machine. The cutting head or cutter head typically includes a plurality of cutting tools, openings for ingesting excavated material and often contains ports for injecting other materials such as, for example, water or lubricants or soil conditioners into the material being excavated. The front end, and the phrase "in response to" means that the rotations of the cutter head and rotating vessel part(s) are directly or indirectly by means of one or more common motors.

The rotating part(s) of the vessel can be any vessel part the rotation of which agitates, preferably mechanically, the excavated materials-containing slurry contained in the vessel. For example, the part(s) can include one or more of a paddle, a blade, a raised surface of the cutter head, an outer or inner surface of the vessel, baffles, ridges or any other passive or active protrubances that assist in mechanically agitating the ore. The rotating part(s) can be part of the outer surfaces of the vessel or be separate therefrom. The part(s) of the enclosed vessel can rotate at substantially the same speed of the cutter head or at a speed different from the cutter head by means of a gear and clutch assembly. As will be appreciated, chemical adjuvants, such as alkalis, can be added to assist bitumen recovery.

The cutter head can be configured in a number of ways. For example, the cutter can include one or more jets for injecting (typically hot) water ahead of the cutter head and one or more mechanical cutting tools mounted on the front of the cutter head. Exemplary cutting tools include discs, drag bits, ripper teeth and combinations of these such as, for example, drag bits and water jets. Exemplary cutting tools also include any number of specialized cutter tools well-known to TBM tunnelers in the civil tunneling industry.

The vessel and cutter head can be in different operating modes. For example, the vessel and cutter head can rotate in one operational mode and the vessel can remain stationary while the cutter head rotates in another operational mode. The latter operational mode is made possible by a clutch assembly operable to operatively disengage the at least part of the enclosed vessel from the cutter head. In the latter operational mode, the slurried materials in the vessel are allowed to separate such that they can be removed from the slurry. Alternatively, the separation can be effected during part rotation by suitably configuring the vessel.

The final slurry can be pumped into any number of processing vessels to effect a significant degree of bitumen extraction. Processing vessels include, for example, abaltion drums, counter flow de sanding drums, hydrocyclone centrifuging systems and drums that can separate bitumen by the well-known Clark process.

Because the machine is typically located underground, the pressure inside the enclosed vessel is generally superatmospheric. For example, the pressure inside the enclosed vessel can be at or near a formation pressure within of an adjacent subsurface formation. By maintaining a superatmospheric pressure within the vessel, emissions of greenhouse gases can be reduced and some aspects of the bitumen extraction process can be enhanced. For example, gases associated with the bitumen particles can remain with the particles and help them float to the top for more efficient removal.

To permit the excavated material pass through the cutter head and into the vessel, the cutter head typically has one or more openings operable to pass the excavated hydrocarbon-containing materials through the cutter head and into the enclosed vessel. As is known to those skilled in civil tunneling, these openings can be sized to permit only the desired size of ore required by the particular processing method employed.

The enclosed vessel and its supporting systems can be configured to effect bitumen separation by any suitable technique, particularly by the Clark and/or CCDS techniques.

In another embodiment, a hydrocarbon extraction and excavation system is provided that includes the following components:

(i) a tunnel boring machine, comprising a cutter head;

(ii) a Counter Current De-Sanding (CCDS) drum in communication with input ports in the cutter head, at least one first input port operable to receive material excavated by the cutter head; and (iii) an excavated material transport system operable in communication with the at least one first input port and at least one second input port in the CCDS drum to transport material from the at least one first input port to the at least one second input port in the CCDS drum. The CCDS drum and material transport system are contained inside of the tunnel boring machine.

The CCDS drum be of any suitable configuration, such as a bitmin drum, or any other type of vessel in which the ore feed moves in the opposite direction through the vessel as the water used to agitate and heat the ore to cause the bitumen to separate. The drum typically includes a first outlet for a bitumen rich stream and a second output for waste material and wherein the tunnel boring machine comprises at least one discharge port positioned behind the machine to discharge at least most of the waste material outputted by the CCDS drum.

The machine can include a heat exchanger for heating water prior to input into the CCDS drum. The heat exchanger is in thermal communication with at least one thermal generating component of the tunnel boring machine.

The present invention can have a number of advantages. For example, compared to current surface mining techniques co-location of the tunnel boring machine and bitumen separation system, coupled with backfiling of waste material, can consume less energy and provide substantial cost savings through decreased material handling and decreased surface storage requirements for waste material. Energy consumption can be reduced substantially through the use of waste heat of the excavation process. The use of a funnel boring machine can cause minimal surface disturbance compared to surface mining techniques and permits excavation of hydrocarbon deposits in "no man's" land. Because openings in the cutter can be suitably sized, large rocks can be prohibited from entering into the vessel or drum until it is comminuted to a suitable size by the cutter head. Bitumen separation can be effected with low rates of de-aeration of the recovered bitumen, thereby avoiding problems in downstream stages of separation. Performing bitumen separation underground can permit methane and other greenhouse gases to be captured and not released into the atmosphere as greenhouse gases and avoid the relatively uncontrollable separation of bitumen in hydrotransport systems.

These and other advantages will be apparent from the disclosure of the invention(s) contained herein.

The above-described embodiments and configurations are neither complete nor exhaustive. As will be appreciated, other embodiments of the invention are possible utilizing, alone or in combination, one or more of the features set forth above or described in detail below.

BRIEF DESCRIPTION OF THE DRAWINGS

FIG. 3A shows a front view of a typical cutter head of the shielded mining machine of FIG. 1;

FIG. 3B shows a side cross-sectional view of cutter tools and slurry entry openings;

DETAILED DESCRIPTION

Bitumen Separation Using Variations of the Clark Process

In one embodiment, the present invention includes a shielded mining machine that excavates oil sand material by using a combination of mechanical cutters, water jets and the action of a hot water slurry and a chamber for performing bitumen separation using a variation of the Clark process. The mechanical agitation of the hot slurry reduces the size of the clumps of oil sand and other material while the combination of mechanical agitation and hot water causes the bitumen to begin separating from the sand grains. When the material reaches a desired size, it is ingested through a rotating cutter head into a pressure chamber. The pressure chamber is formed by the rear of the rotating cutter head, an outer shield and a pressure bulkhead. Additional hot water and air may be added to the slurry in the pressure chamber. The material remains in the pressure chamber where it continues to be agitated by the rotation of the cutter head. The combination of hot water and mechanical agitation further reduces the size of the material and further separates the bitumen from the sand grains. After a selected residency time in the pressure chamber, the material is suitable to be pumped as a slurry from the pressure chamber to additional processing apparatuses in the mining machine. In an alternate embodiment, the cutter head rotation may be stopped allowing the heavier ore components (sand, clays etc) to settle and the lighter components (bitumen, gases, water) to rise to the top of the pressure chamber where a bitumen froth can be removed by any number of means known to those skilled in mine processing techniques. The present invention is a means whereby the nature of the well-known TBM slurry excavation process is configured to also accomplish: (1) excavation of the oil sands material; (2) desired comminution or size reduction of the material; (3) partial to complete separation of the ore (bitumen) from the waste material (sand); (4) preparation of the slurry to be compatible with a hydrotransport system or further processing inside the TBM; or (5) alternately removal of a substantial portion of the bitumen froth in the pressure chamber. Most or all of the energy to heat the water for the slurry is provided by waste heat from other systems of the mining machine. Throughout the processing, the excavated material is contained in a closed system so that gases such as methane contained in the bitumen can be utilized for floatation, controlled and eventually captured.

Figure 1:
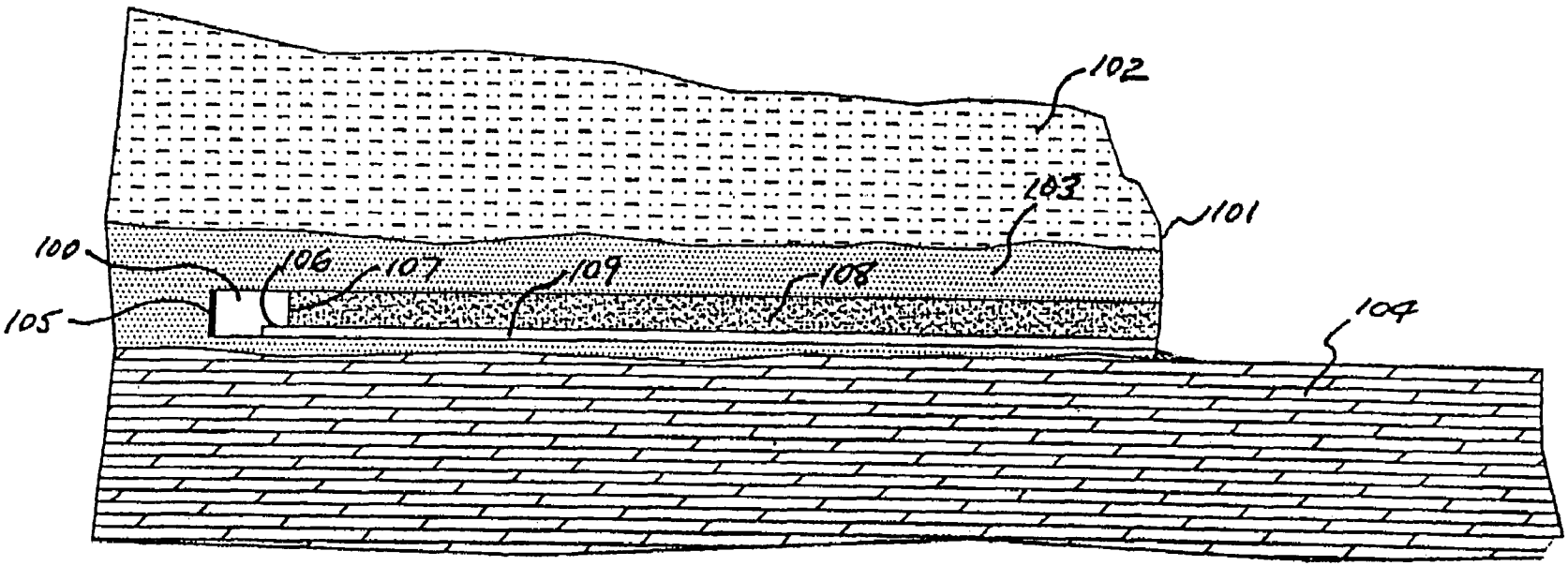
FIG. 1 shows a side view of a shielded mining machine according to a first embodiment of the present invention.
Figure 2:
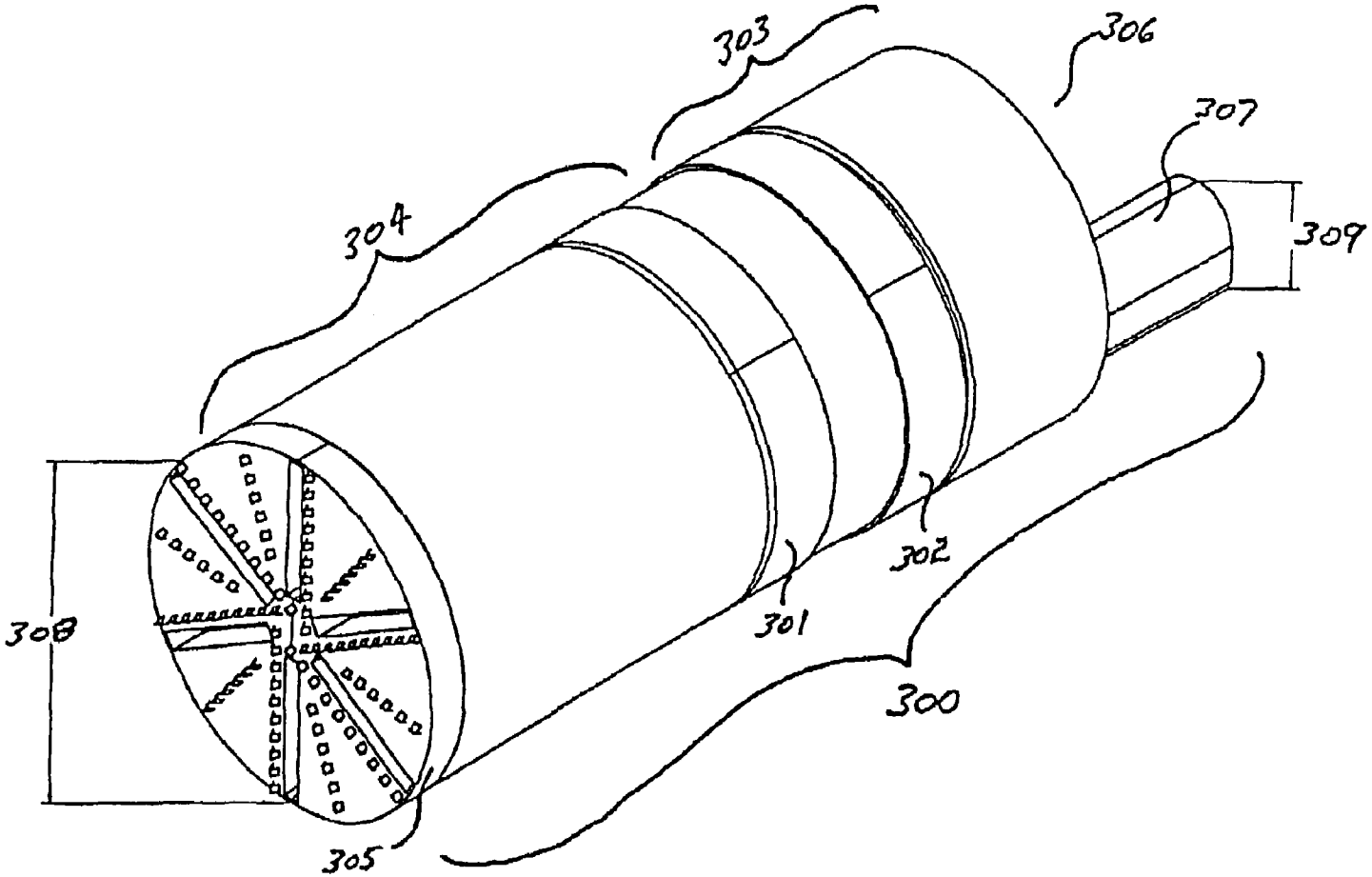
FIG. 2 shows an isometric view of the shielded mining machine of FIG. 1.

The mining machine used in the present invention is shown in FIGS. 1 and 2. Unlike the machine described in U.S. patent application Ser. No. 09/797,886, in which a shielded machine excavates a soft-ore material such as oil sand, prepares the oil sand as a slurry and transports the slurry in a hydrotransport system to the surface via a trailing access tunnel emplaced behind the advancing machine. The bitumen or heavy-oil is then separated from the sand matrix in an outside surface facility. Alternatively, bitumen separation could be carried out inside the mining machine in a conventional bitumen separation apparatus.

In the present invention, oil sands deposits are excavated by well-known slurry or Earth Pressure Balance ("EPB") tunnel boring machine ("TBM") methods or variations of these methods. These methods were primarily developed to control face stability in soft ground civil tunneling applications. In the present invention, the oil sands are excavated using slurry methods because (1) it is an efficient means of excavation in oil sands and (2) it is desired to convert the excavated material to a slurry for hydrotransport haulage away from the working face. The oil sands are excavated by forming a slurry of hot water mixed with excavated material outside the machine in front of the cutter head. The in-situ material is excavated by mechanical cutters and/or water jets that protrude through the slurry layer to contact the in-situ material. The grinding action of the slurry, as it is rotated by the cutter head, also contributes to the excavation of the in-situ material.

In the present embodiment of the invention, the oil sands may also be cut with a dense slurry (slurry density of in the range of approximately 1,600 kg/cu m to 1,750 kg/cu m which, in oil sands corresponds to approximately 67% to 77% solids by mass, or approximately 48% to 60% solids by volume).

In the present invention, it is envisioned that the mining machine will eventually operate in formation pressures as high as 20 bars. Currently, soft-ground machines can operate in formation pressures as high as 8 to 10 bars. The pressure range of the slurry in front of the of the cutter is preferably in the range of 1.1 bars to 20 bars, more preferably in the range 1.5 to 12 bars and most preferably in the range 1.5 to 8 bars, where 1 bar represents ambient atmospheric pressure.

The hot water may be provided by a water heating system in the machine; or by heat exchangers in the machine which utilize the waste heat from, for example, the TBM hydraulic cylinders and electric motors. This hot water may be injected under pressure into the slurry by one of several means, including by water jets. The slurry may also be heated by the mechanical action of the cutters on the cutter head and by the friction of the material against itself as it is rotated between the cutter head and the unexcavated material.

In current surface oil sands mining operations, the bitumen in oil sands is separated by a process commonly known as the Clark process, although other processes, using varying amounts of temperature, mechanical agitation and chemical additives, are being evaluated. The bitmin drum is an example of an alternate oil sands extraction technology.

Oil sand is a dense interlocked skeleton of predominantly quartz sand grains with pore spaces occupied by bitumen, water, gas and minor amounts of clay. The sand grains are whetted by water and the bitumen does not directly contact the grains. In the Clark process, the action of hot water, agitation-and some chemical additives causes the bitumen to separate from the sand grains by breaking the water bond between the bitumen and the quartz grain. Variants of the Clark process eliminate the need for chemical additives by increasing the heating or mechanical agitation or both and by increasing the residency time of processing. The action of the slurry or EPB excavation in front of the TBM cutter head using hot water can be considered a version of the Clark process and, thus, the act of excavating the ore also helps initiate the bitumen extraction and separation process.

The hot slurry in front of the cutter head causes the clumps of oil sand to break down (ablate) because of the combined action of hot water and grinding of the material against (1) itself, (2) the cutter tools on the cutter head, (3) the cutter head itself and (4) the unexcavated oil sand material. The oil sand material may also contain small rocks, cobble stones and boulders such as, for example, mudstone or shale. These will also tend to be broken up during the slurry excavation process. These rocks and rock fragments also help to grind the oil sand material. Thus, the slurry excavation process in front of the cutter head is acting simultaneously as a crushing and an autogenous milling process.

The temperature of the hot water in the slurry in front of the of the cutter is preferably in the range of 15° C. to 90° C., more preferably in the range 25° C. to 80° C. and most preferably in the range 35° C. to 65° C. The maximum typical dimension of the fragments resulting from the excavation process in front of the of the cutter is-preferably in the range of 0.02 to 0.5 meters, more preferably in the range of 0.05 to 0.3 meters and most preferably no greater than 0.02 to 0.1 meters.

The action of breaking the clumps of oil sand also tends to reduce the well-known abrasivity of the oil sand material. The heating of the bitumen tends to reduce the sticky nature of the oil sands and the bitumen.

The cutter head has various types of cutter tools mounted on its front face and contains the slurry entry openings (sometimes called muck buckets). These openings are sized to allow only certain size of material to pass through the cutter head into a pressure chamber behind the cutter head as shown, for example, in FIG. 3.

Figure 4:
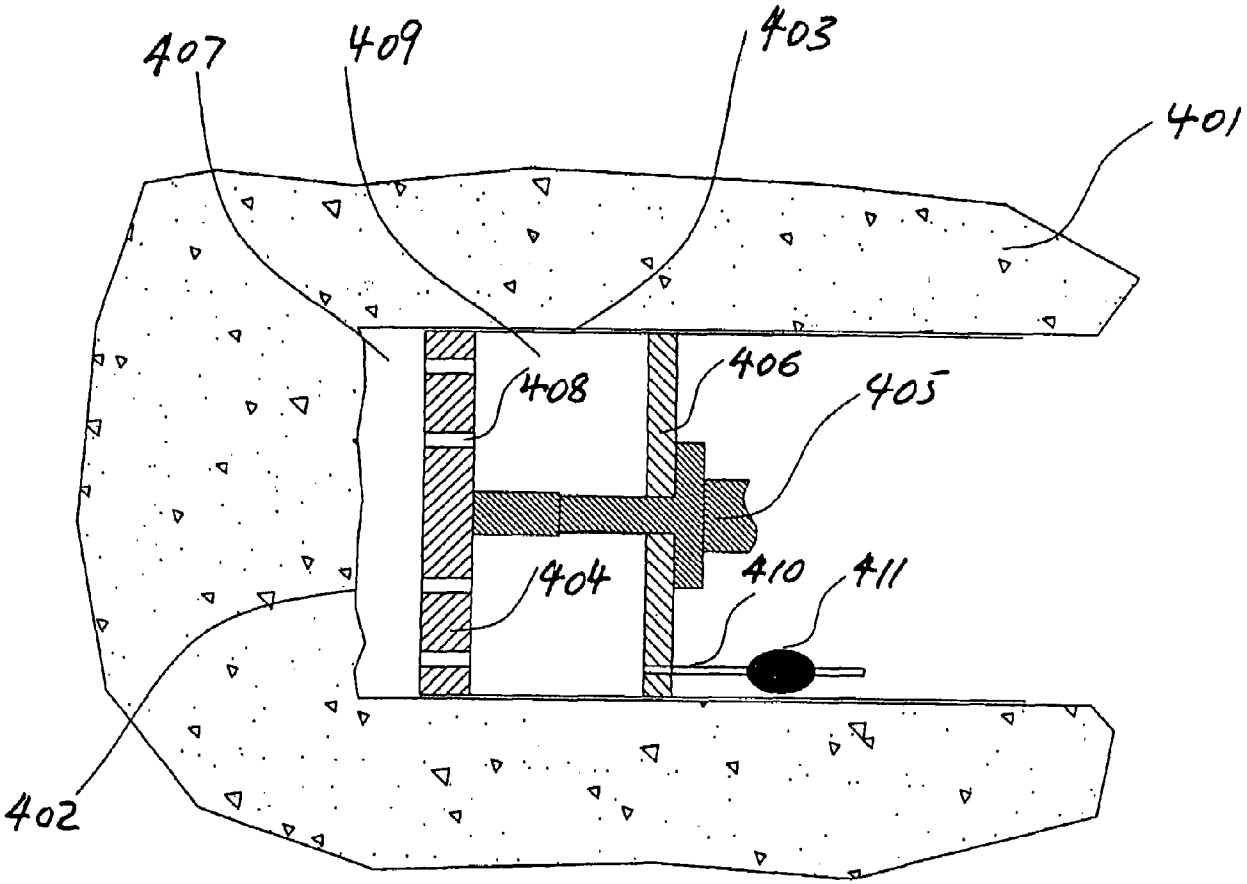
FIG. 4 shows a side view of the shielded mining machine of FIG. 1.

The pressure chamber is a closed, pressurized vessel bounded by a shield on its periphery, the back of the rotating cutter head on one side and the front of a pressure bulkhead on the other side, as shown in FIG. 4. In general, the pressure in the pressure chamber is the same as or substantially the same the pressure in the slurry at the excavating face. This pressure may be slightly lower, the same as, or slightly higher than the local formation pressure at the excavation face. In one configuration; the minimum pressure in the vessel is superatmospheric pressure and the maximum pressure is about 20 bars, more preferably about 10 bars, and even more preferably about 5 bars. The pressure is controlled by adjusting the pressure in the pressure chamber. When the slurry pressure is approximately the same as the local formation pressure, any methane, carbon dioxide or other gases dissolved in the bitumen tend to stay dissolved and are not released.

Once the slurry enters the pressure chamber behind the cutter head, additional hot water may be added. The back of the cutter head, the main bearing housing attached to the cutter head, the front of the pressure bulkhead (which remains stationary) and/or the interior of the shield may have baffles, impellers and paddles, for example, attached to their surfaces to enhance the agitation of the material as it is rotated in the pressure chamber by the action of the rotating cutter head. The material in the pressure chamber is further crushed and comminuted by the action of the material against itself and against the walls of the pressure chamber. The hot water furthers the separation of the bitumen from the sand grains by overcoming the water bonding forces between the bitumen and sand grains. The pressure chamber thus serves as vessel in which a version of the Clark process is continued on from that outside the cutter head. The pressure chamber also acts as a second autogenous mill and beneficiation facility since the material is further reduced in size and more bitumen is separated from sand grains.

Figure 5:
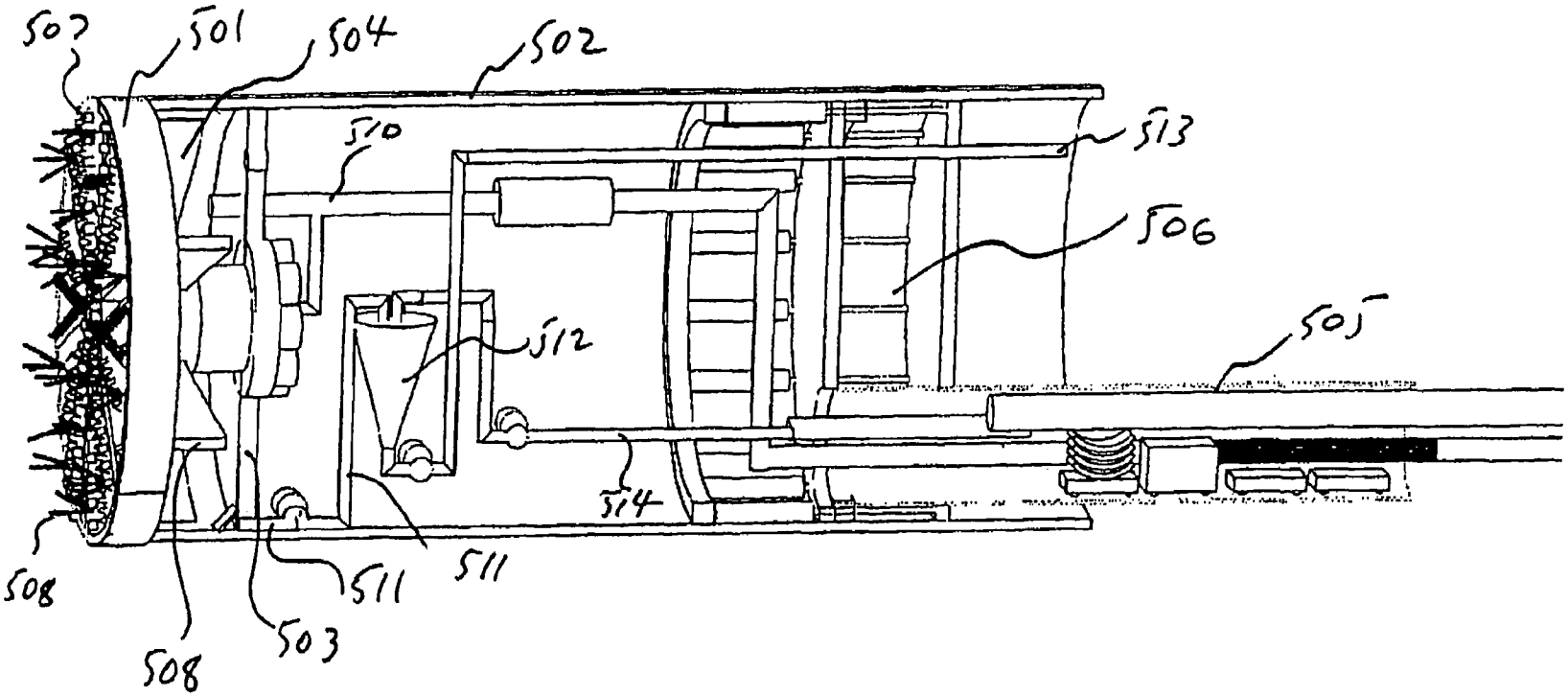
FIG. 5 shows an isometric view looking from the forward perspective of the shielded mining machine of FIG. 1.
Figure 6:
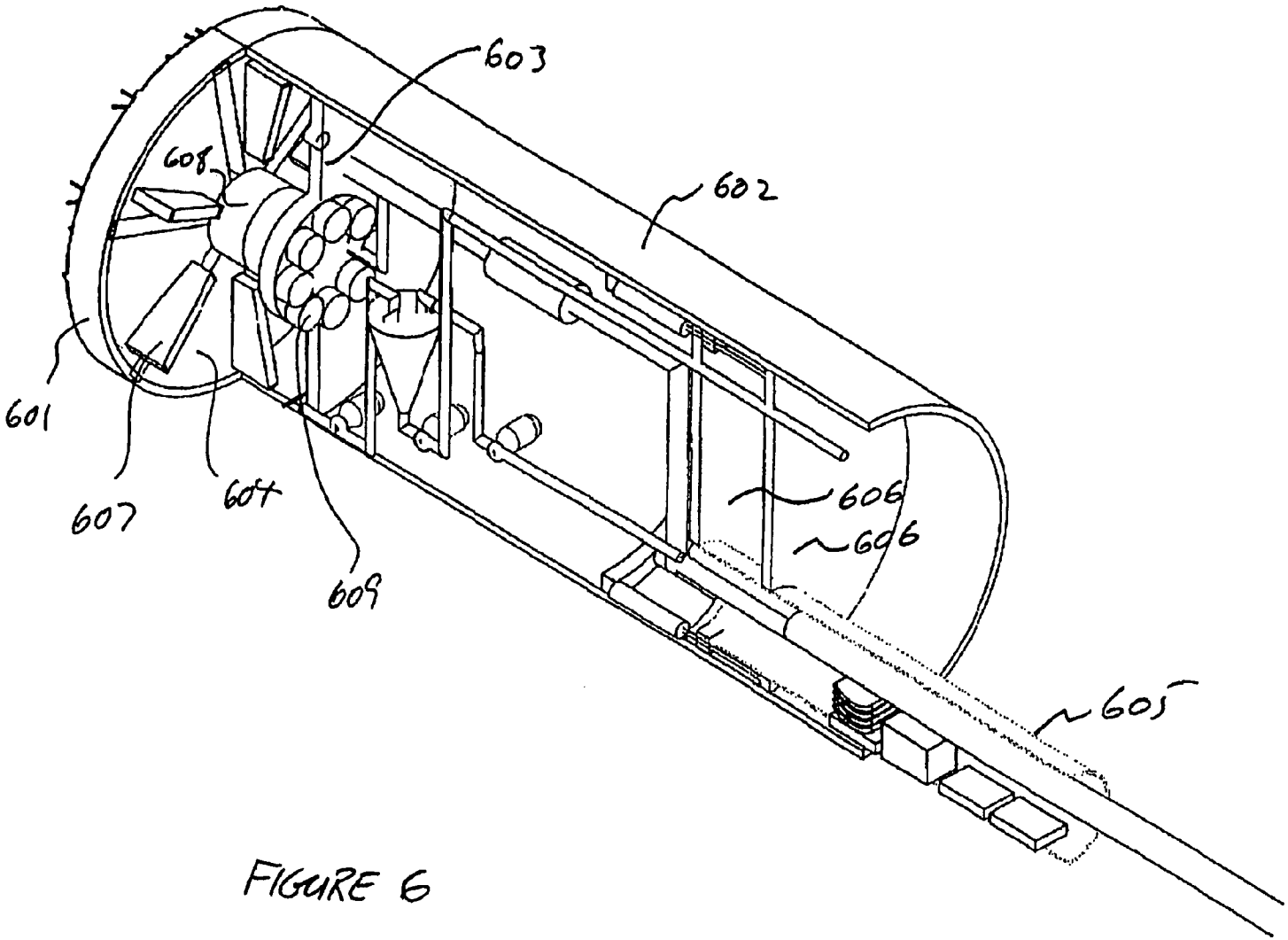
FIG. 6 shows an isometric view looking from the rear perspective of the shielded mining machine of FIG. 1.

An example of a machine with baffles attached to the back side of a rotating cutter head in the pressure chamber is shown in FIGS. 5 and 6.

Figure 7:
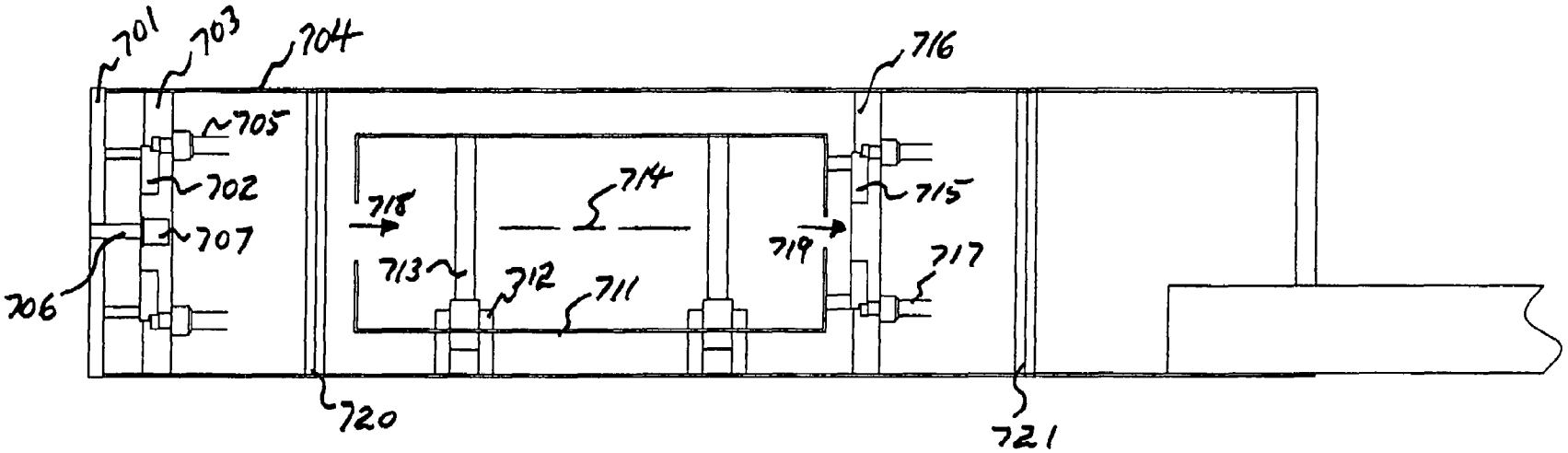
FIG. 7 shows a side cross-sectional view of an excavation machine according to another embodiment of the present invention.

As will be appreciated, the chamber may be configured as a drum operatively engaged with the cutting head, such that the entire drum rotates at the same speed as the cutter head. The drum may be defined by the cutter head as the front surface, the shield exterior of the TBM as the side surface, and a wall adjacent to and in front of the bulkhead as the rear surface. The drum may also be defined by the cutter head as the front surface, a wall separate from the shield exterior as the side surface, and a wall adjacent to and in front of the bulkhead as the rear surface. The drum may also be defined by a wall adjacent to and behind the cutter head as the front surface, the shield exterior or a wall separate from the shield exterior as the side surface, and a wall adjacent to and in front of the bulkhead as the rear surface. The drum when configured in the latter manner may be disengaged from the cutter head, such as by a clutch and gear arrangement, such that drum rotation can be stopped while the cutter head continues to rotate. The drum may also be connected to the cutter head or to one or more common motors shared with the cutter head via a gear assembly to provide a lower (using a step-down gear ratio) or higher (using a step-up gear ratio) rate of rotation than the cutter head. An example of an alternate embodiment in which the pressure chamber is mounted separately from the cutter head chamber is applied may be rotated separately is shown in FIG. 7.

The pressure chamber may not be always full and may contain some air. Air may also be added to the slurry in the pressure chamber. Air can attach to the bitumen particles to promote development of a bitumen froth which acts to enhance the final separation of bitumen from the waste material.

The apparatus to excavate, comminute and separate ore from waste is envisioned as a fully shielded machine such as, for example, a tunnel boring machine ("TBM"). An example of such a machine is shown from two angles in FIGS. 5 and 6. The principal components relating to the present invention are the cutter head, the main body shield, the pressure bulkhead, the rotating cutter head drive system and the various water heating/injection and hydrotransport system components. The pressure chamber is contained between the cutter head and the pressure bulkhead which are contained within the main body shield.

The excavating apparatus is formed by a rotating cutter head mounted at the front of a shield that comprises a shielded mining machine such as shown in FIG. 2. The cutter head is rotated by a single closed drive system central shaft such as shown, for example, in FIGS. 5 and 6, or by a plurality of closed drive systems mounted around and just inside the periphery of the shield. The rotary power to the shafts is provided by electric or hydraulic motors, for example, in any number of configurations commonly used by the tunnel boring machine (TBM) industry. As an example, a closed drive system may consist of a series of motors acting on a ring gear and main bearing assembly such as shown schematically in FIGS. 5 and 6. Typically, the main bearing assembly is attached to the cutter head. The cutter head rotates within the front end of the shield and is sealed against the non-rotating shield by any number of sealing means commonly used by the TBM industry.

The front of the rotating cutter head is shown in FIG. 5 with water jets, various mechanical cutter tools (such as drag bits or disc cutters, for example), and slurry entry ports (muck buckets). The slurry entry ports may contain grills, for example, to control the size of material that can pass through the ports.

The cutter head is rotated by any number of means normally practiced in modern civil TBM tunneling machines. The cutter head is attached to a main bearing assembly which is a closed system for transferring the rotary power to the cutter head. The cutter head is sealed against the main body shield of the machine. The atmosphere in the manned portion of the inside of the machine is, in general, isolated from the pressure of the formation gases and fluids by a number of sealing methods commonly employed by civil TBM tunneling machines.

A pressure chamber is a closed chamber-located behind the cutter head and is formed by the shield on its periphery, the back of the rotating cutter head on one side and the front of a pressure bulkhead on the other side, as shown in FIG. 4.

FIG. 6 illustrates paddles attached to the rear of the cutter head. Additional paddles may be attached the stationary main bearing housing. These baffles and paddles cause mechanical agitation of the slurry in the pressure chamber and further comminute the larger clumps of ore and waste; and continue to separate the bitumen from the sand grains of the oil sand material. The diameter and length of the pressure chamber are sized to maintain the slurry in the pressure chamber for a residency time necessary to optimize the separation of bitumen from the sand grains.

The length of the pressure chamber, expressed as a ratio of length of the pressure chamber to diameter, D, of the cutter head, is preferably in the range of 0.05 D to 2 D, more preferably in the range of 0.1 D to 1 D and most preferably in the range 0.1 D to 0.5 D. The rotational speed of the cutter head, expressed as a function of the diameter, D in meters, of the cutter head, is preferably in the range of 5/D rpm to 30/D rpm and most preferably in the range of 7/D rpm to 20/D. Typically, the rotational speed of the cutter head ranges from about 0.5 to about 5 rpm.

The rear of the pressure chamber is formed by a pressure bulkhead which is fixed to the main body shield as shown in FIGS. 5 and 6. Water is injected through this bulkhead as needed to modify the slurry to be compatible with a hydrotransport system. Air may also be injected through this bulkhead, if required.

Any methane or carbon dioxide gases that form in the pressure chamber may be suctioned out of the pressure chamber by any of a number of well-known means such as referred to, for example, in paper reference 8 in the Appendix. If methane and other gases remain dissolved in the bitumen, they may be removed in a separate process when the bitumen slurry is delivered via hydrotransport means to bitumen processing apparatuses downstream of the pressure chamber.

When the slurry is broken down to the desired maximum size of material in the pressure chamber, it is passed through the pressure bulkhead via a hydrotransport (slurry) system using slurry pumps.

The resulting slurry is then suitable for either (1) hydrotransport out of the rear of the machine, down the trailing access tunnel, through the access tunnel portal to the surface; or (2) a short hydrotransport to a bitumen separating device within the machine. Because the material is highly fragmented and a substantial portion of the bitumen is separated from the sand, it may be processed by a hydrocyclone device such as shown in FIGS. 5 and 6. This type of device can separate the bitumen and the sand by centrifuging, such that the sand waste can be used for backfill behind the advancing shielded mining machine (as described in U.S. patent application Ser. No. 09/797,886 and a primarily bitumen slurry can be hydrotransported out of the rear of the machine, down the trailing access tunnel, through the access tunnel portal to the surface. In the event there is excess waste material after backfilling, it may be necessary to separately hydrotransport this excess waste material to the surface. Alternately, the hydrocyclone device illustrated in FIGS. 5 and 6 may be replaced by an ablation drum such as described for example in Canadian Patent No. 1,167,238; or bitmin drum such as described for example in Canadian Patent No. 2,124,199; or any other device used to process oil sands.

FIG. 1 shows a cross-sectional a view of a tunneling machine 100 mining into an oil sand deposit 103 from a prepared face 101 which has been formed by removing overburden material 102 to expose the oil sand deposit 103. The oil sand deposit 103 typically lies on top of a basement rock 104 and under the overburden 102. The mining machine 100 advances and mines into the oil sand 103 by excavating oil sand material 103 continuously through the front end 105 which maybe, for example, a rotary cutter head. As the mining machine 100 advances, an access tunnel liner 106 is formed inside the machine 100. As the machine 100 advances, the liner 106 remains in place and is left behind the advancing machine 100. Also as the machine 100 advances, waste material from the bitumen separation process is deposited as backfill 108 behind the machine 100 through an opening 107 in the rear of the machine 100. The backfill 108 surrounds the liner 106 leaving an access tunnel 109. The machine 100, the liner 106 and the backfill 108 all act to support the remaining oil sand 103 and overburden 102 such that there is negligible motion of the ground surface 110. These operations are discussed in detail in U.S. patent application Ser. No. 9/797,886.

FIG. 2 shows an isometric front view of the mining machine of the present invention illustrating a typical size comparison of the excavation cross-section and the trailing access tunnel cross-section as well as two tail shields. This figure illustrates a closed face TBM cutter head, a long outer shield and a trailing access tunnel. The TBM excavates through the oil sands and processes the ore inside the shield. The access tunnel connects the excavation with the outside world and is the conduit for all material inputs and outputs as well as for the personnel who operate the machine. As the TBM advances, the access tunnel is formed and left in place. Thus the entire operation is shielded. The access tunnel is considerably smaller in cross-sectional area than the excavation and this (1) allows low ground support costs which makes the process economically viable and (2) provides a volume for the tailings to be backfilled behind the machine. In soft ground or soft rock, tunnel boring machines can be advanced by thrusting against the tunnel liner structure which has approximately the same cross-sectional geometry as the boring machine. In one embodiment of the invention of U.S. patent application Ser. No. 09/797,886, only a small tunnel liner is left behind so the machine should be propelled forward by other means. In this configuration, the mining machine may be formed from two telescoping segments and propelled forward by conventional soft-ground grippers which thrust against the walls of the excavation or by the aft most segment thrusting against the backfill or by a combination of both means of propulsion.

FIG. 2 shows an example of a tunnel boring mining machine 200 that can be propelled by using external grippers 201 and 202. The rear section 203 of the machine is shown with full circumferential grippers 202 that grip by being pushed out against the excavation walls usually by hydraulic rams. When the rear section 203 grippers 202 are pushed out against the excavation walls, the forward section 204 of the machine, which includes the cutterhead 205, can thrust forward by pushing against the rear section 201. Once the forward section 204 is fully or almost fully extended, then the retracted grippers 201 on the forward section 204 can be pushed out against the excavation walls while the grippers 202 on the rear section 203 are retracted. Now, hydraulic cylinders inside the machine (not shown) can retract and draw the rear section 203 of the mining machine forward. This is an example of a propulsion cycle for a two segment machine. As noted previously, the rear section can also thrust off the backfill 206 behind the machine and around the trailing access tunnel 207, if necessary. The diameter 208 of the mining machine 200 is typically in the range of about 10 to about 20 meters. The trailing access tunnel 207 is much smaller in cross-sectional area having a typical dimension 209 in the range of about 2.5 to about 4 meters.

FIG. 3*a* shows a front view of the left half of a typical slurry or EPB TBM cutter head 301. This view shows examples of cutter bits 302, auxiliary cutter bits 303 and water injection ports 304. Typically, the cutter head 301 may be rotated in either direction. The cutter bits 302 may be arrayed as shown in two orthogonal rows (as shown for example in FIG. 3*a*) or in any other suitable pattern, depending on the geology of the ground in which the machine is designed to excavate. FIG. 3*b* shows a cross-sectional view of cutter bits 305 and material entry ports 306. When the size of the excavated material fragments 307 is small enough, the fragments 307 will pass through the entry ports 306 into the pressure chamber 308 behind the rotating cutter head 309.

FIG. 4 shows a cross-sectional a view of a shielded machine mining into an oil sand deposit 401 with the material being excavated at a working face 402. The shielded mining machine consists of an outer shield 403, a rotating cutter head 404, a cutter head drive system 405 and a stationary pressure bulkhead 406. An oil sand and water slurry 407 is formed between the rotating cutter head 404 and the working face 402. As this slurry is rotated, the excavated oil sands clumps and other rock material are ground down in size and some of the bitumen is separated from the sand. When the material size is small enough, it can pass through slurry entry openings 408 the cutter head 404 into a pressure chamber 409. The pressure chamber 409 is formed by the rotating cutter head 404, the shield of the machine 403 and the pressure bulkhead 406. The material in the pressure chamber 409 is further reduced in size and the bitumen further separated from the sand grains until the size of the material can pass through a screen, for example, at the entrance-of a slurry pipe 410. The slurry that passes through the entrance of the slurry pipe 410 is pumped by a suitable slurry pump 411 to other processing apparatuses (not shown) such as, for example, one or more hydrocyclone devices, or ablation drums for further separation of the bitumen and waste material.

FIG. 5 shows an isometric view looking from the forward perspective of a mining machine suitable for performing the processes of the present invention. This figure shows a rotating cutter head 501, an outer shield 502, a pressure bulkhead 503, a pressure chamber 504, a trailing access tunnel 505 and a thrust/backfill system 506. The front of the cutter head 501 shows cutters 507 and water jets 508. Large paddles 509 are shown attached to the rear of the rotating cutterhead 501. A water injection pipe 510 is shown for adding hot water to the material in the pressure chamber 504. When the material in the pressure chamber 504 has been comminuted to a suitable size, it can enter a slurry pipe 511 to be delivered to a hydrocyclone centrifuging apparatus 512. In this embodiment, the waste (primarily sand) from the hydrocyclone is injected as backfill from pipe 513. The separated bitumen slurry is sent via a hydrotransport pipeline (slurry pipeline) 514 out the access tunnel 505 to the surface. Any excess waste material can also be sent to the surface by a hydrotransport pipeline (not shown).

FIG. 6 shows an isometric view looking from the rear perspective of a mining machine and further illustrates the principal components shown in FIG. 5. This figure shows a rotating cutter head 601, an outer shield 602, a pressure bulkhead 603, a pressure chamber 604, a trailing access tunnel 605 and a thrust/backfill system 606. Large paddles 607 are shown attached to the rear of the rotating cutter head 601. The cutter head 601 is driven by a central closed drive system 608 which is powered by a set of motors 609.

FIG. 7 shows a schematic side view of a preferred embodiment of the present invention focusing on the principal elements of the rotary drive systems for the TBM cutter head and pressurized Clark process chamber. A cutter 701 head is rotated by a large ring 702 mounted in a bulkhead 703. The bulkhead 703 is attached to the main TBM shield 704. The ring 702 is driven by a series of hydraulic motors 705 mounted around the bulkhead 703. A typical slurry TBM has a plurality of such motors 705, usually arranged at equal intervals around the bulkhead 703. The alignment of the cutter head 701 is maintained by a central shaft 706 which is mounted at the center of the cutter head 701 and passes through a pressure bulkhead 703 utilizing a rotary joint 707. The rotary joint 707 is used, for example, to pass slurry additives, water and hydraulic fluids to the cutter head 701. This TBM cutter head drive system uses many highly developed bearings, rotary seals, joints and other mechanisms that have been developed for the civil TBM industry to perform various functions, handle high loads, absorb shocks and remain lubricated and functional in a highly variable environment of dust, fluids, gases and rock. A bitumen extraction drum 711 is shown within the-main TBM shield 704. The extraction drum 711 is shown here mounted on roller bearings 712, attached to the shield 704 and which constrain the location of extraction drum 711 by two or more large rings 713. The extraction drum 711 is rotated about its central axis 714 by a large ring 715 mounted in a second bulkhead 716. The bulkhead 716 is attached to the main TBM shield 704. The ring 715 is driven by a second series of hydraulic motors 717 mounted around the bulkhead 716. As with the cutter head drive system, a plurality of motors 717 maybe arranged around the bulkhead 716. The slurry ore from the cutter head chamber is input to the extraction drum 711 through opening 718. Additional water and air may be inputted to the extraction drum through other conduits not shown. When the rotation of the extraction chamber is stopped from time to time, the bitumen froth separated from the ore slurry may be removed by any number of means known to those skilled in the art. The remaining tailings may then removed from the extraction drum through opening 719 to be dewatered, if necessary, and then used as backfill behind the advancing machine. Thus, there is-no need for a central shaft or rotary joint such as typically used on the TBM drive system. One or more of the cutter head bulkhead 703 and the extraction drum bulkhead 716 should be a pressure bulkhead. If a pressure bulkhead, the bulkhead should be able to maintain a pressure differential in the range of preferably 0.1 to about 5 bars, more preferably 0.1 to about 10 bars and most preferably 0.1 to about 20 bars. The preferred embodiment shown here would also have an articulation joint 720 at approximately the location shown. The joint would be articulated and sealed using methods commonly used on TBMs used in civil tunnel boring. The machine may have additional articulation joints such as shown for example by the joint 721. These articulated joints increase the ability to steer the machine.

Bitumen Separation Using a Counter Flow DeSander Process

In one embodiment, the present invention includes a shielded mining machine that excavates oil sand material by using a combination of mechanical cutters, water jets and the action of a hot water slurry and a chamber for performing bitumen separation using the a Counter Flow DeSander Process or CCDS process. It is possible to put a counterflow desander device such, as for example, a bitmin drum inside a large TBM as a separate apparatus. Calculations show that an approximately 9-meter diameter by 20-meter long bitmin drum would be required to match the desired steady state production capacity of a 15-meter diameter TBM. This embodiment of the present invention integrates the two apparatuses, namely the TBM and the CCDS process, based on common components and requirements of both rotary drive systems.

To economially mine oil sands underground, a high production method should be employed. The preferred production rate should be in the range of 500 to 3,000 tonnes per hour. (A tonne of ore will yield approximately 0.5 to 0.7 barrels of bitumen per tonne of ore in the economic deposits of the Athabasca oil sands.) This range of production rates requires a large tunnel boring machine (in the range of 10 to 20 meters in diameter) and a large bitmin drum for extraction (in the range of 6 to 12 meters in diameter). A large tunnel boring machine will have a cutter head rotation speed in the range of 0.5 to 2 rpm. A bitmin drum capable of the required range of production will also have a drum rotation speed in the range of 0.5 to 2 rpm. Thus, in a preferred embodiment, the cutter head and bitmin drum can be rotated by separate drive systems utilizing common drive method and components. In another embodiment, both the cutter head and the bitmin drum can be rotated using a common drive system.

The cutter head of the tunnel boring machine will be required to stop for maintenance and also be required to reverse rotation direction to accomplish some steering, thrust and other functions. The rotation of the bitmin drum can be slowed and stopped but, in general, not at the same rate as the TBM cutter head. In addition, it is preferred that the bitmin drum always be rotated in the same direction if its internal fins and pockets are in a fixed position (this requirement can be eliminated if the internal components of the bitmin drum can be repositioned for opposite rotation with appropriate mechanisms). In general, the bitmin drum should be able to be independently rotated. The TBM cutter head and the bitmin drum can both start and stop operation without damaging effects on the ore or the ability to restart. This avoids the additional complexity of recirculating slurries and is another innovation of the present invention.

The cutter head of the TBM and the drum of the bitmin drum can, if desired, be rotated in opposite directions to improve substantially the rotational stability of the overall machine. For example, a 15-meter diameter TBM may have a cutter head whose rotating components weigh in the range of 500 to 800 tonnes. In operation, the slurry rotated by the cutter head may have a total mass in the range of 500 to 900 tonnes. The slurry does not all rotate at the same speed as the cutter head. A 9-meter diameter bitmin drum may have rotating components weighing in the range of 200 to 300 tonnes. In operation, the bitmin drum may contain in the range of 600 to 900 tonnes of ore. Thus, the angular momentum (measured about the axis of rotation of the cutter head and the bitmin drum, which are parallel with one another) of the cutter head and its rotating slurry is about the same as the angular momentum of the fully loaded bitmin drum. If the cutter head and bitmin drum are rotated in opposite directions, their angular momentums would tend to cancel out, substantially reducing the roll tendency of the overall machine.

The bitmin drum is known to function most-efficiently by ingesting dry or damp oil sands ore into its front end while warm water is injected into its back end to create the desired counter-flow de-sanding action. The approximate limits on the water content of the ore feed desired for a bitmin drum are: (i) a solids content greater than about 90% by weight which corresponds to greater than about 80% by volume and (ii) a slurry density greater than about 1,990 kg/m$^3$.

If the ore feed to the bitmin drum contains additional water (typically a solids content below about 90% by weight), the bitmin drum desanding action may be substantially degraded or even rendered totally ineffective.

The TBM can cut the oil sands dry, damp or wet. Usually the choice, from the TBM standpoint, is made on the basis of face stability conditions. The oil sands represent a unique TBM cutting environment. The oil sands can be cut dry and will not release the dissolved gases (typically 80% methane and 20% carbon dioxide) if the cutting is done at local formation pressure. The oil sands may be cut with some water (damp) if this is appropriate from a tool wear and face stability standpoint, or if water is naturally present in the oil sands deposits. The oil sands may also be cut with a dense slurry (slurry density of approximately 1,750 kg/cu m or approximately 77% solids by mass, 60% solids by volume).

The TBM can be made to cut in any of the above modes and adjusted to deliver the most desirable feedstock to the bitmin drum. Further, the cutter head may be designed to remove a portion of the water from the excavated material so that the cutter head slurry is close to optimal for cutting purposes while the feedstock to the bitmin drum is close to optimal for extraction purposes. The ability to adjust the cutting slurry water content is also an important innovation of the present invention.

The maximum size of oil sands lumps, clay lumps or rock fragments is dictated by the ore feed opening into the bitmin drum. This sizing requirement can be met by controlling the size of openings (often called muck buckets) in the TBM cutter head. This feature is another advantage of combining a TBM with a bitmin drum since it eliminates the need for a separate crusher.

Preferably, in the proposed integrated system is that the excavated material be isolated from the manned portion of the TBM interior. The excavated material should also be able to be held at a desired pressure which is approximately at the local formation pressure. This requirement means that the interior of the bitmin drum should also be isolated from the manned portion of the TBM interior held at approximately the same pressure as the excavated material.

The formation pressures in which the TBM will operate are typically in the range of about 100 to about 1,000 kPa. It is not expected that these pressures will materially affect the performance of the bitmin drum as long as the pressure inside the bitmin drum remain at least substantially constant.

As noted previously, substantial methane and carbon dioxide are dissolved in in-situ bitumen at formation conditions. This dissolved gas is a significant greenhouse gas source if liberated into the atmosphere. This gas can, however, assist the extraction of bitumen from the oil sands if it remains: dissolved and attached to the bitumen particles. By operating a bitmin drum at formation pressure, the gases contained in the oil sands can be used to promote separation of the water and bitumen. This is because water and bitumen have densities that are very similar (both about 1,000 kg/m$^3$) and the gases dissolved and attached to the bitumen particles lower its density and allow it to float to the surface as, for example, required by most of the separation processes practiced in the Athabasca oil sands industries. Further the gases can be captured during the separation process so that they can be prevented from escaping to the atmosphere and contributing to other emitted greenhouse gases. The ability to operate the bitmin drum in a closed and pressurized mode another advantage of the present invention.

Figure 8A:
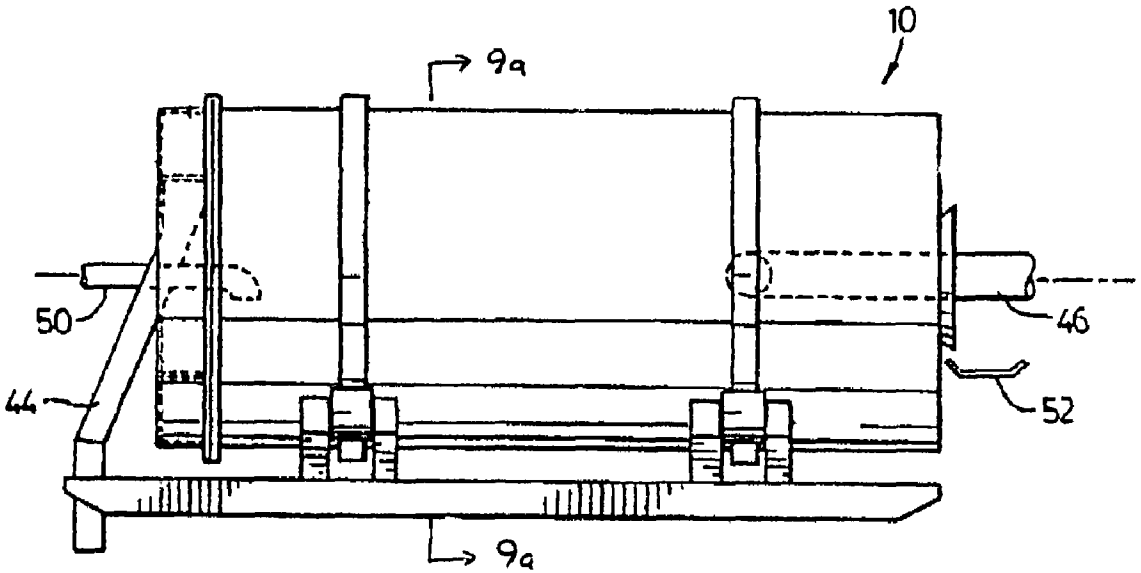
PRIOR ART FIG 8a
FIGS. 8*a* and *b* show, respectively, side and cross-sectional side views of a bitmin drum such as described in Canadian Patent 2,124,199.
Figure 8B:
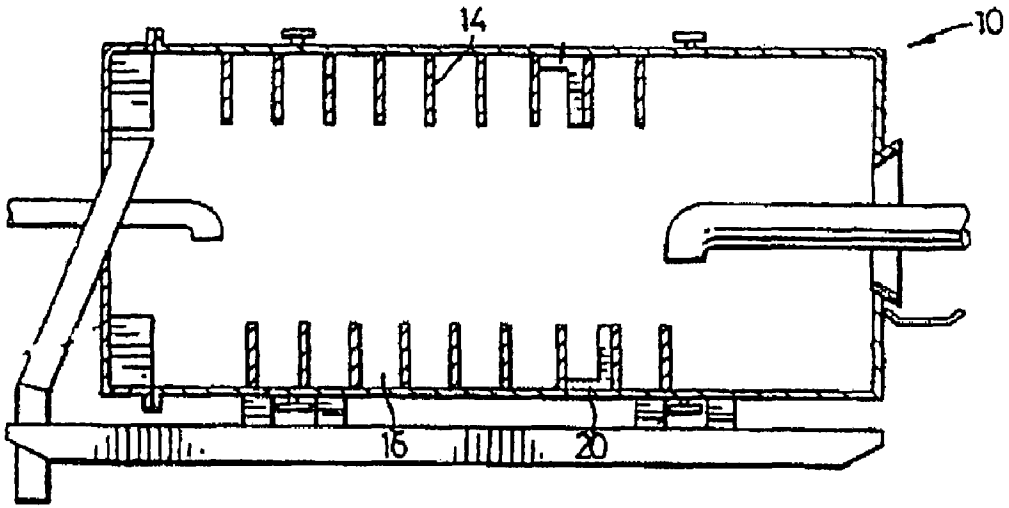
PRIOR ART FIG 8b
Figure 9B:
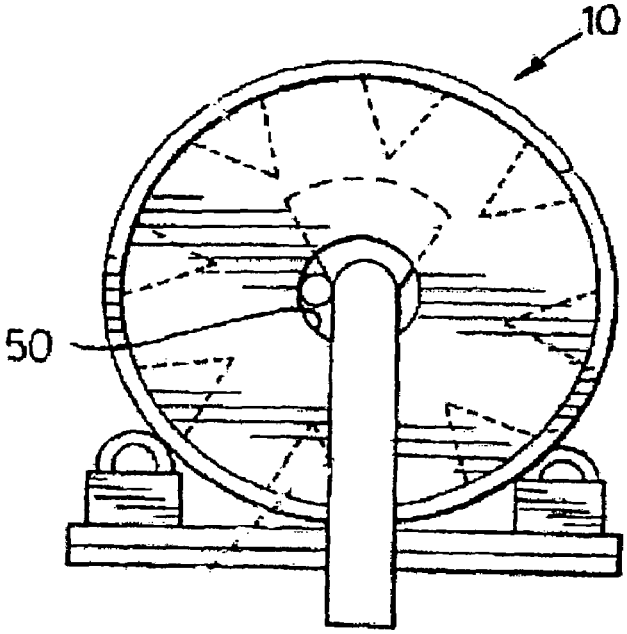
PRIOR ART FIG 9b
FIGS. 9*a* and *b* show, respectively, a cross-sectional view of the bitmin drum along line 9*a*-9*a*' of FIG. 8*a* and an end view of the bitmin drum.
Figure 9A:
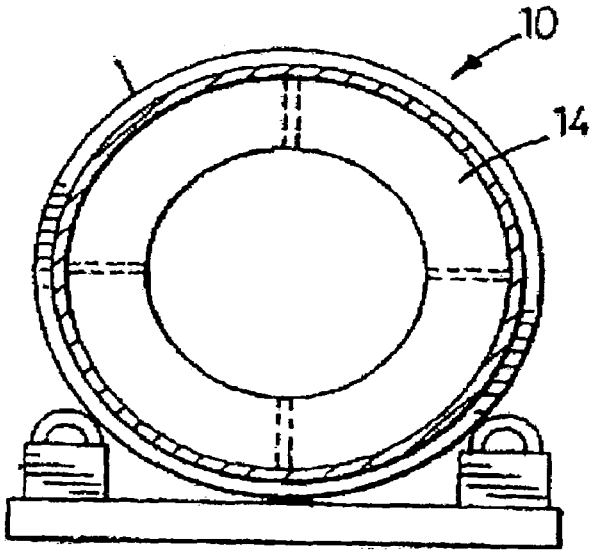
PRIOR ART FIG 9a

FIG. 8*a* and *b* show a bitmin drum such as described in Canadian Patent 2,124,199. This is an example of a counterflow de sander apparatus 10. In FIG. 8*a*, oil sands ore is fed in via the conduit 46 at the front end while heated water is injected in via conduit 50 at the back end. Solids discharge (tailings) are discharged from the back end via conduit 44 while a lean bitumen froth (the valuable product) is collected at the front end via conduit 52. FIG. 8*b* shows the internal spiral paddle 14 and other devices which set up the flow required to preferentially separate the bitumen from the oil sands by ablation while passing the lumps of clay with little ablation as described, for example, in Canadian Patent 2,124,199. FIGS. 9*a* and *b* show end views of the bitmin drum. FIG. 9*a* shows the front end where the ore is fed in while FIG. 9*b* shows the rear end where heated water is injected.

Figure 10:
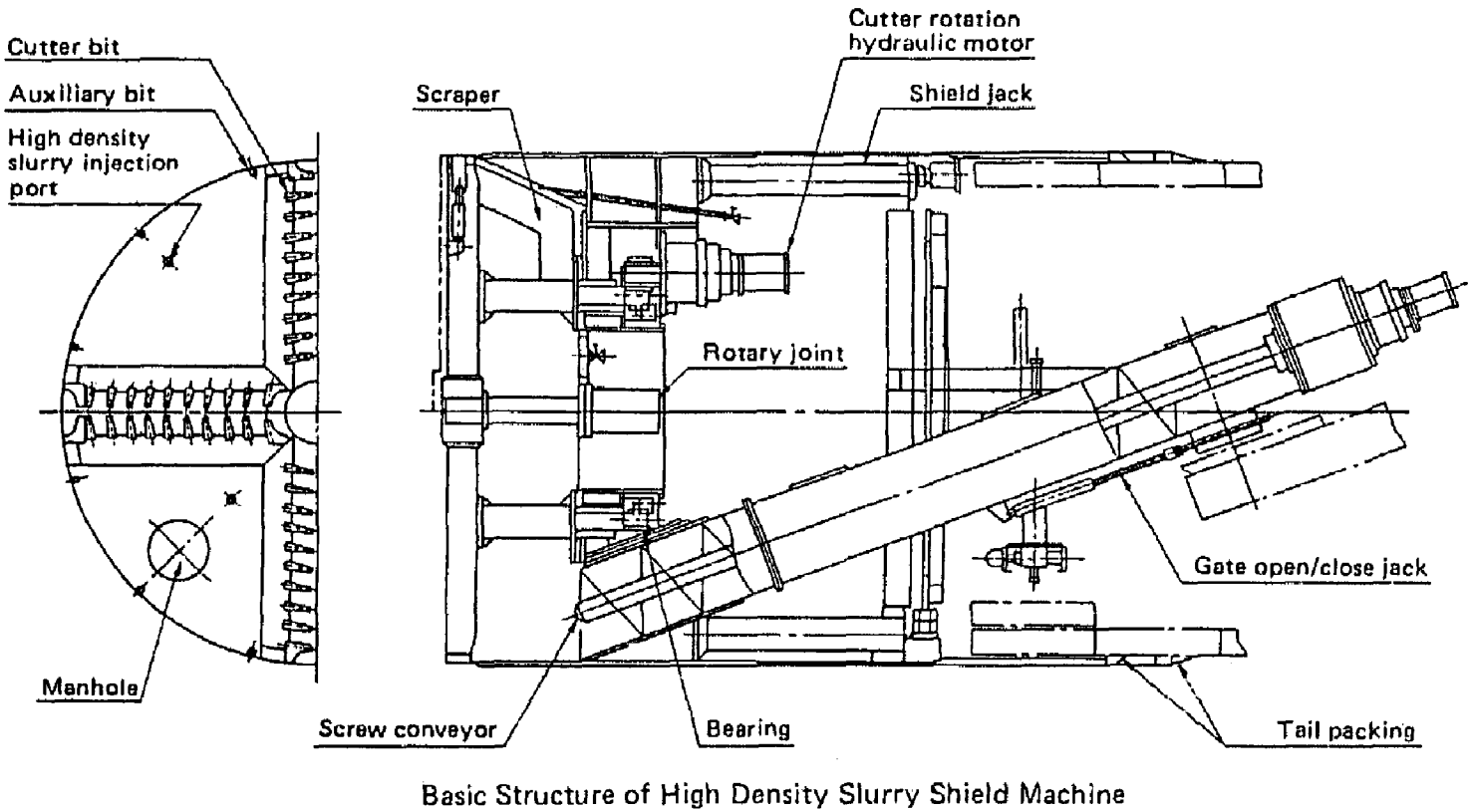
FIGURE 10 (PRIOR ART)
FIG. 10 shows a schematic of a conventional slurry TBM cutter head drive system.

FIG. 10, which is prior art, shows a schematic of a typical slurry TBM cutter head drive system and muck conveyor apparatus as described in "Mitsubishi Shield Machine", sales brochure, Mitsubishi Heavy Industries, Ltd, Construction Machinery Division, No. 84-11, 1984. The cutter head is rotated by a large ring mounted in the bulkhead. The ring is driven by a series of hydraulic motors mounted around the bulkhead. For example, a TBM with a 7-meter diameter cutter head may have somewhere between 10 and 18 such hydraulic motors. The alignment of the cutter head is maintained by a central shaft which is mounted at the center of the cutter head and passes through a pressure bulkhead utilizing a rotary joint. The rotary joint is used, for example, to pass slurry additives, water and hydraulic fluids to the cutter head. The muck or excavated material is collected near the bottom of the cutter head and conveyed through the pressure bulkhead, for example, by a screw auger. In this schematic, the screw auger maintains a pressure differential across its length. This is typical of slurry and Earth Pressure Balance ("EPB") TBMs used for civil construction projects.

Figure 11:
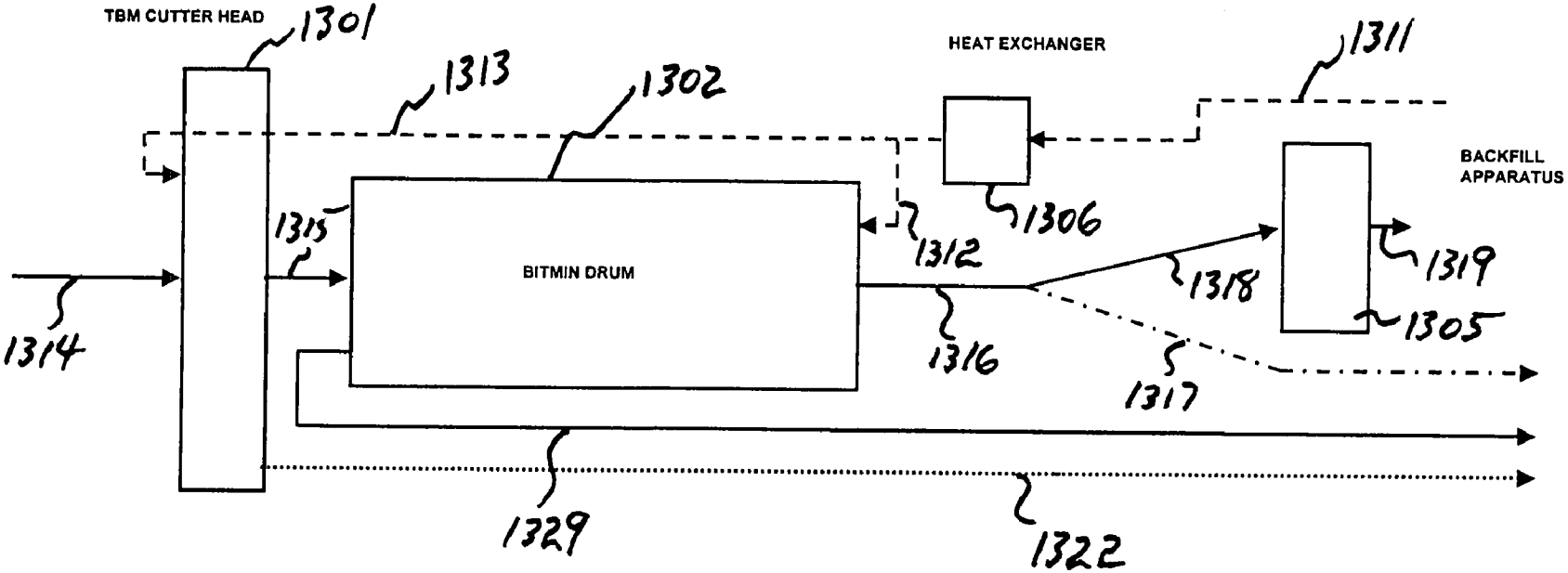
FIG. 11 shows a process flow diagram according to another embodiment of the present invention.

FIG. 11 shows a schematic flow diagram for a combined TBM and bitmin drum apparatus. The principal elements of the system are the TBM cutter head 1301, the bitmin drum 1302, a backfill apparatus 1305 and a heat exchanger apparatus 1306. Appropriately clean water is fed into the system along path 1311 and is heated as it passes through the heat exchanger 1306. The clean water is conveyed into the machine from the surface through an access tunnel (not shown, but formed behind the advancing TBM as described in U.S. patent application Ser. No. 09/797,886). The heat required for the heat exchanger 1306 can come from any heat source such as, for example, from the waste heat from the TBM motors and hydraulics. A fraction of the heated water is injected into the bitmin drum 1302 along path 1312. The remainder of the heated water is supplied to the TBM cutter head 1301 along path 1313. The water supplied to the TBM cutter head 1301 may be used for water jets to aid the cutting action or to form a cutting slurry ahead of the cutter head or both. Oil sands ore is produced at the cutter head 1301 either as a dry ore or as a damp or wet slurry and enters the cutter head 1301 along path 1314. The oil sands ore is fed into the bitmin drum 1302 along path 1315. Inside the bitmin drum 1302, the ore is processed to produce, in part, a solids discharge which is removed via path 1316. Most of the solids discharge is routed to the backfill apparatus along path 1318 where it is injected as backfill behind the TBM via path 1319. A small portion of the solids discharge may be excess and is removed through the trailing access tunnel (not shown, but formed behind the advancing TBM as described in U.S. patent application Ser. No. 09/797,886) via path 1317. The ore in the bitmin drum 1302 is also processed, in part, to produce a bitumen froth (mixture of water and bitumen) which is collected and removed through the trailing access tunnel via path 1329 to a separation cell (not shown) located typically on the surface. The separation cell, of which several types exist, separates most of the water from the bitumen.

Some water is recovered from the cutting slurry inside the cutting head 1301 and is removed through the trailing access tunnel via path 1322 to a water conditioning unit (not shown) located typically on the surface. The water removed from the cutter head to the surface via path 1322 and the water recovered from the separation cell is available for reuse after being properly conditioned and can be added to the water being supplied along path 1311.

Figure 12:
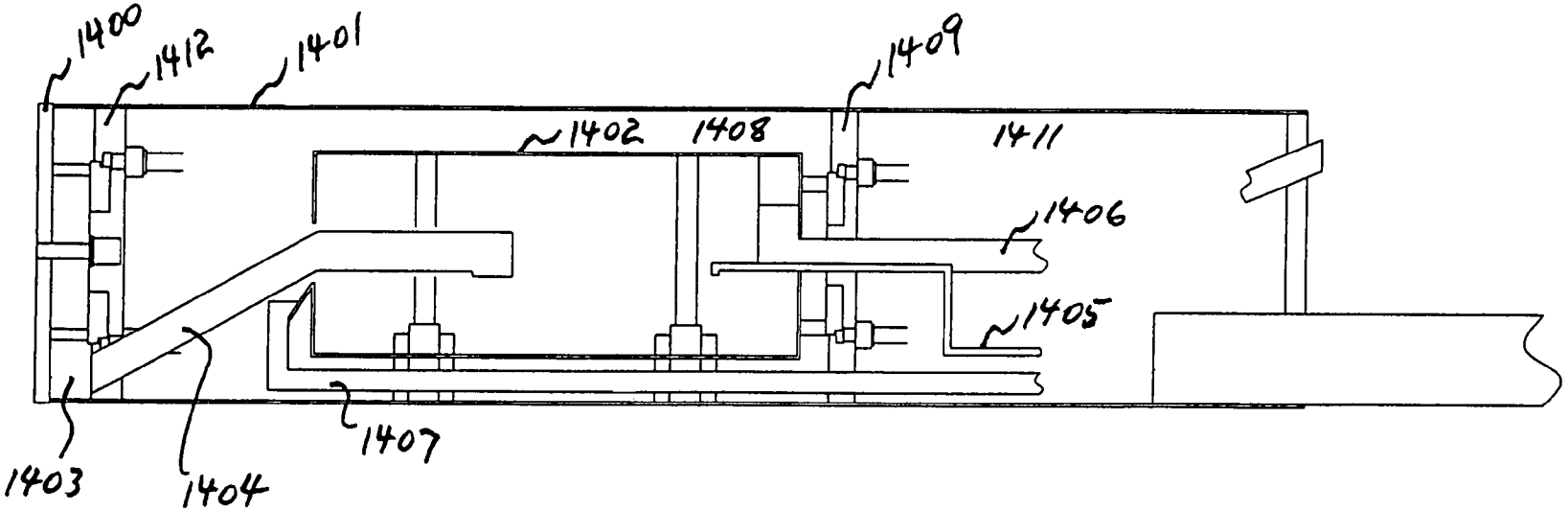
FIG. 12 shows a schematic side view of a machine according to the embodiment of FIG. 11.

FIG. 12 shows a schematic side view of a preferred embodiment of the present invention focusing on the main elements of the invention and the location of the principal material inputs and outputs. The major components of the system are the TBM cutter head 1400, the TBM shield 1401 and the bitmin drum 1402. Oil sands ore is formed in front of the cutterhead 1400, passed through the cutter head 1400 into the TBM slurry chamber 1403 and fed into the bitmin drum 1402 through, for example, a screw auger system 1404. Water is fed into the bitmin drum 1402 through a conduit 1405 in the opposite direction to the ore feed in order to develop the counterflow desanding action. Solids are separated from the ore feed inside the bitmin drum 1402 and are collected and discharged through conduit 1406. Liquids, called a bitumen froth and consisting primarily of bitumen and water, are also separated from the ore feed inside the bitmin drum 1402 and-are collected and discharged through conduit 1407. The components described above all containing on a pressurized side 1408 separated from the non-pressurized side 1411 by a bulkhead 1409. The water feed 1405, the soil discharge feed 1406 and the bitumen froth feed 1407 all pass through the bulkhead 1409 via sealed connections. The pressure on the pressurized side 1408 of the bulkhead 1409 is typically maintained at or sightly above formation pressure so that the methane and other gases dissolved in the oil sands ore is prevented from exsolving into the pressurized chamber.

The bulkhead 1412 between the slurry chamber 1403 and the bitmin drum 1402 may also be a pressure bulkhead as is typically the case, for example, in a slurry TBM used in civil tunneling projects. This would allow the side 1408 to be de-pressurized, for example to perform maintenance on the bitmin drum.

Figure 13:
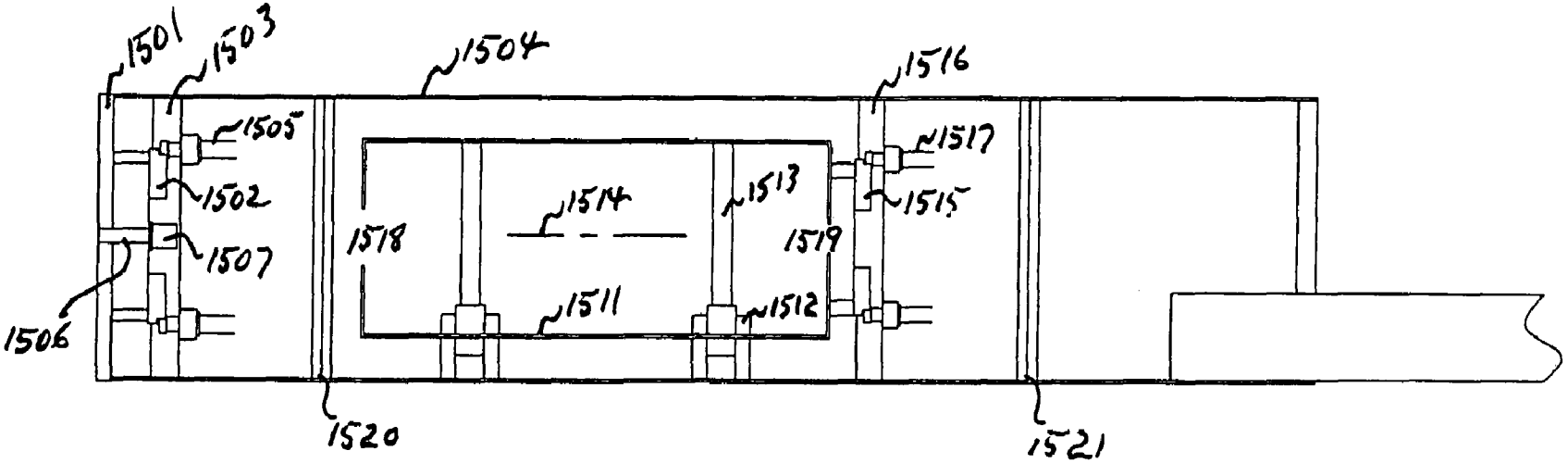
FIG. 13 shows a schematic side view of main cutter head and bitmin drum drive mechanisms according to the embodiment of FIG. 11.
Figure 14:
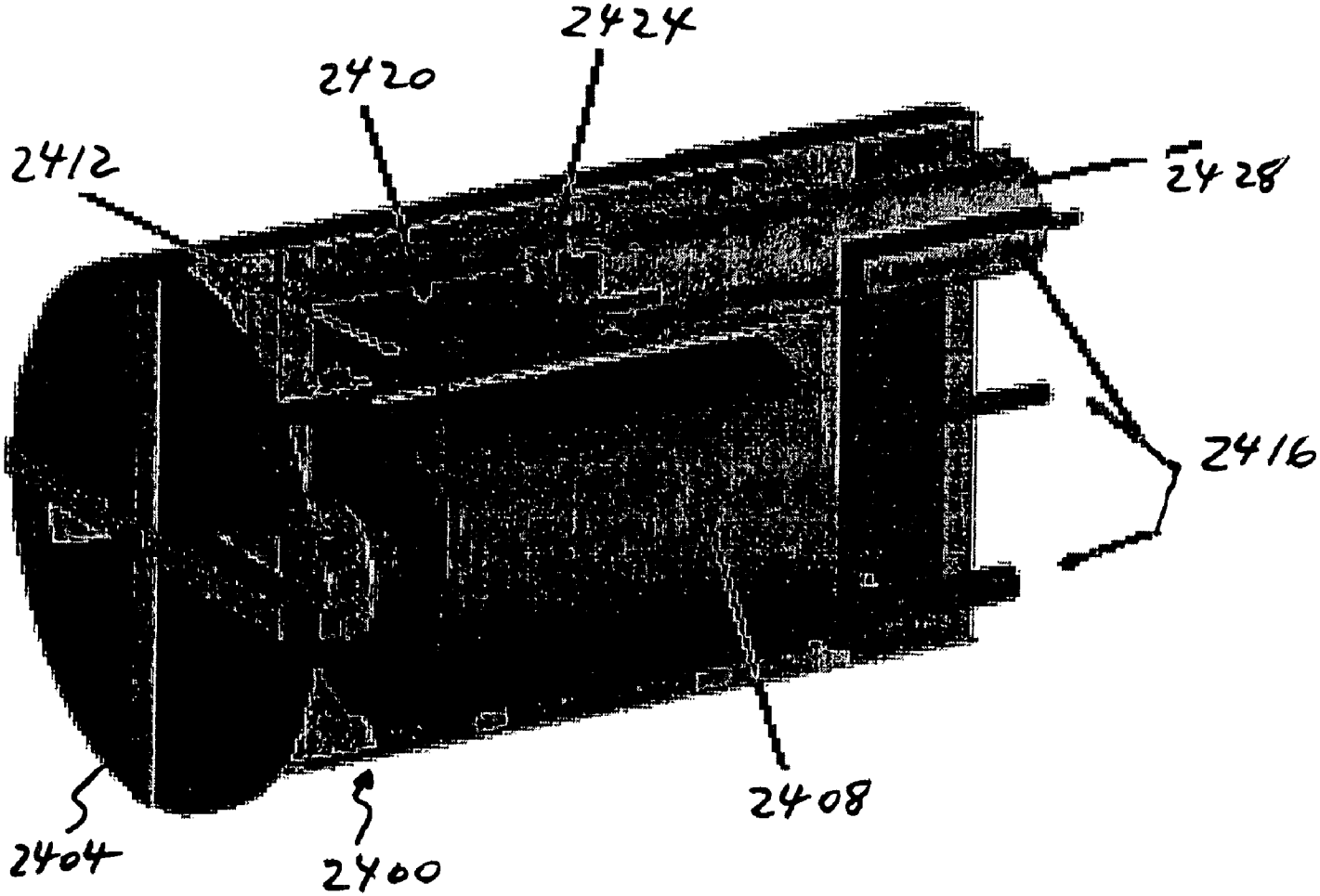
FIG. 14 shows an isometric view of a TBM with an internal bitmin drum apparatus according to the embodiment of FIG. 11.
Figure 15:
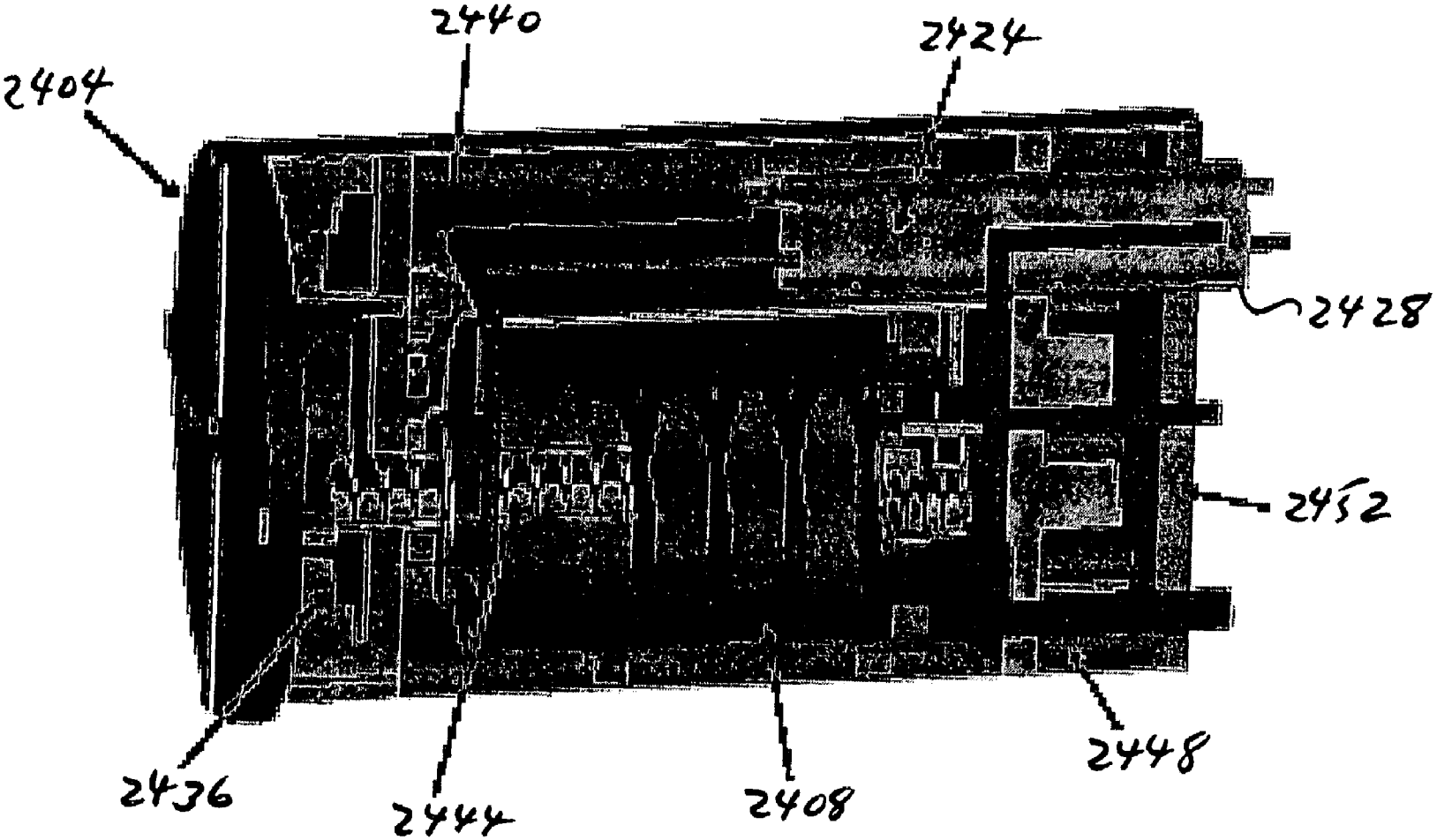
FIG. 15 shows another an isometric view of a TBM with an internal bitmin drum apparatus according to the embodiment of FIG. 11.

FIG. 13 shows a schematic side view of a preferred embodiment of the present invention focusing on the principal elements of the rotary drive systems for the TBM cutter head and bitmin drum. As described in FIG. 11, a cutter 1501 head is rotated by a large ring 1502 mounted in a bulkhead 1503. The bulkhead 1503 is attached to the main TBM shield 1504. The ring 1502 is driven by a series of hydraulic motors 1505 mounted around the bulkhead 1503. A typical slurry TBM has a plurality of such motors 1505, usually arranged at equal intervals around the bulkhead 1503. The alignment of the cutter head 1501 is maintained by a central shaft 1506 which is mounted at the center of the cutter head 1501 and passes through a pressure bulkhead 1503 utilizing a rotary joint 1507. The rotary joint 1507 is used, for example, to pass slurry additives, water and hydraulic fluids to the cutter head 1501. This TBM cutter head drive system uses many highly developed bearings, rotary seals, joints and other mechanisms that have been developed for the civil TBM industry to perform various functions, handle high loads, absorb shocks and remain lubricated and functional in a highly variable environment of dust, fluids, gases and rock. A bitmin drum 1511 is shown within the main TBM shield 1504. The bitmin drum 1511 is shown here mounted on roller bearings 1512, attached to the shield 1504 and which constrain the location of bitmin drum 1511 by two or more large rings 1513. The bitmin drum 1511 is rotated about its central axis 1514 by a large ring 1515 mounted in a second bulkhead 1516. The bulkhead 1516 is attached to the main TBM shield 1504. The ring 1515 is driven by a second series of hydraulic motors 1517 mounted around the bulkhead 1516. As with the cutter head drive system, a plurality of motors 1517 may be arranged around the bulkhead 1516. As illustrated in FIGS. 10, 11 and 12, the inputs and outputs to the bitmin drum 1511 are through openings 1518 and 1519. Thus, there is no need for a central shaft or rotary joint such as typically used on the TBM drive system. One or more of the cutter head bulkhead 1503 and the bitmin bulkhead 1516 should be a pressure bulkhead. If a pressure bulkhead, the bulkhead should be able to maintain a pressure differential in the range of preferably 0.1 to about 5 bars, more preferably 0.1 to about 10 bars and most preferably 0.1 to about 20 bars. The preferred embodiment shown here would also have an articulation joint 1520 at approximately the location shown. The joint would be articulated and sealed using methods commonly used on TBMs used in civil tunnel boring. The machine may have additional articulation joints such as shown for example by the joint 1521. These articulated joints increase the ability to steer the machine.

Figure 16:
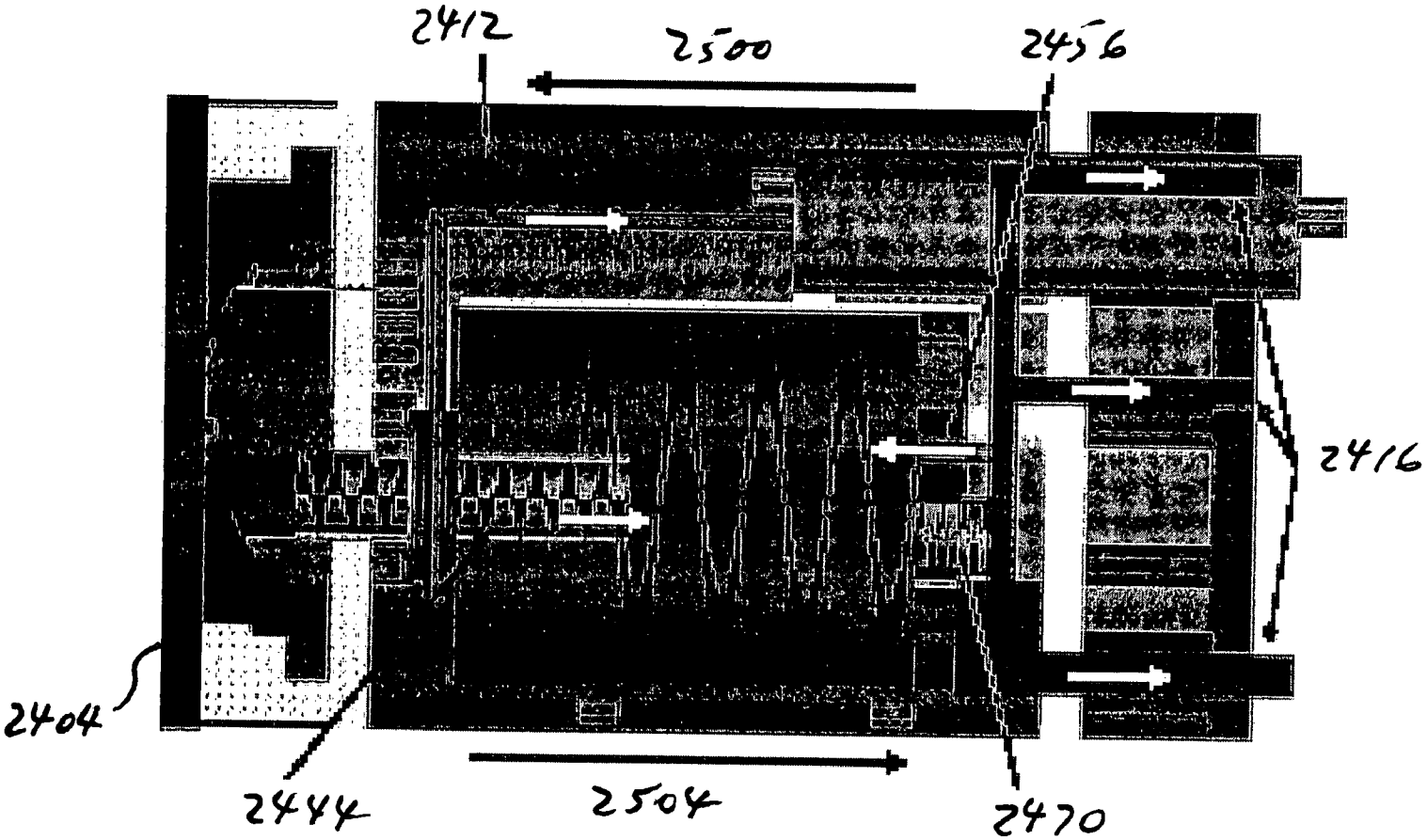
FIG. 16 shows a side view of a TBM with an internal bitmin drum apparatus according to the embodiment of FIG. 11.
Figure 17:
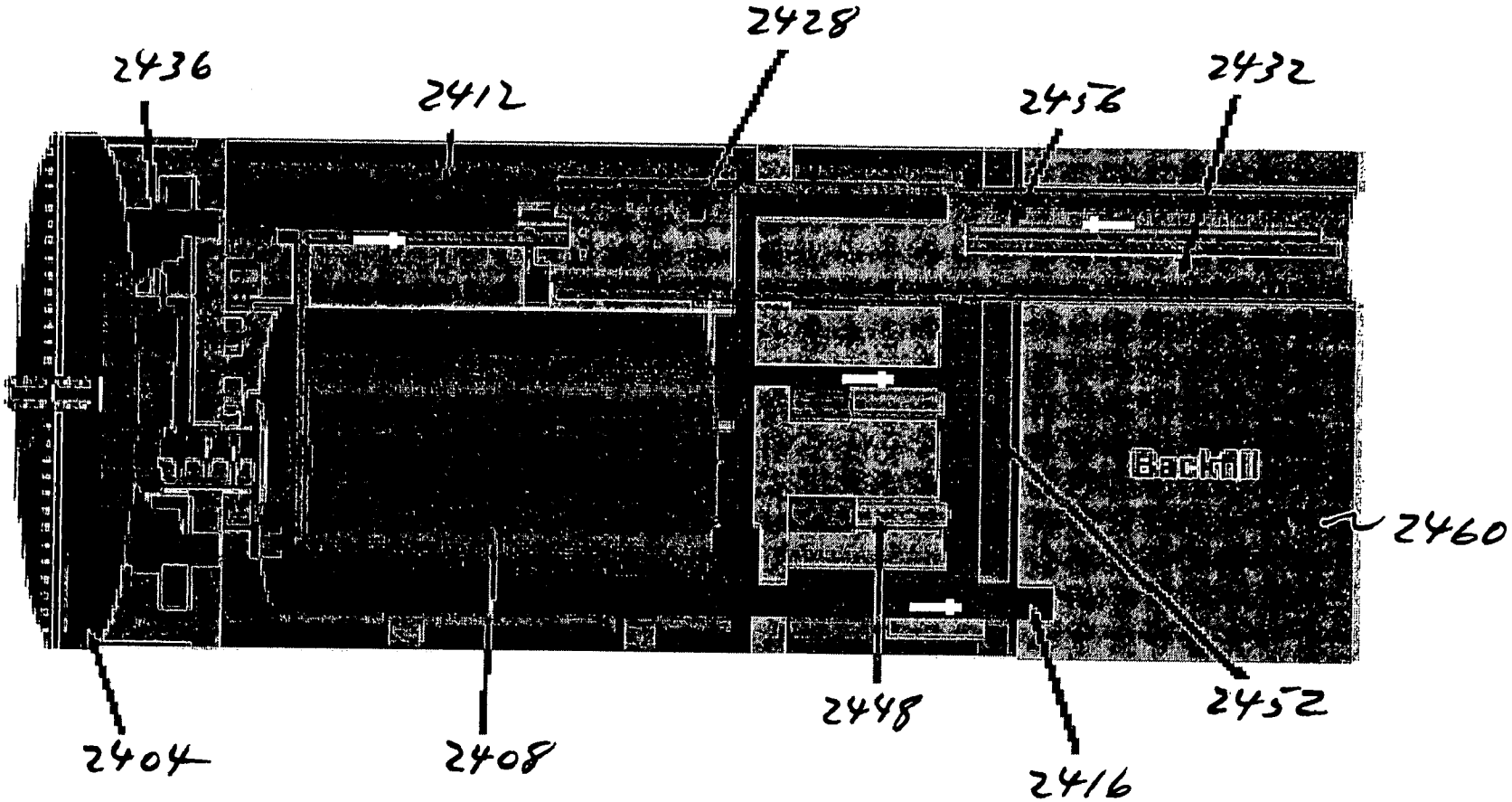
FIG. 17 shows yet another a side view of a TBM with an internal bitmin drum apparatus according to the embodiment of FIG. 11.
Figure 18:
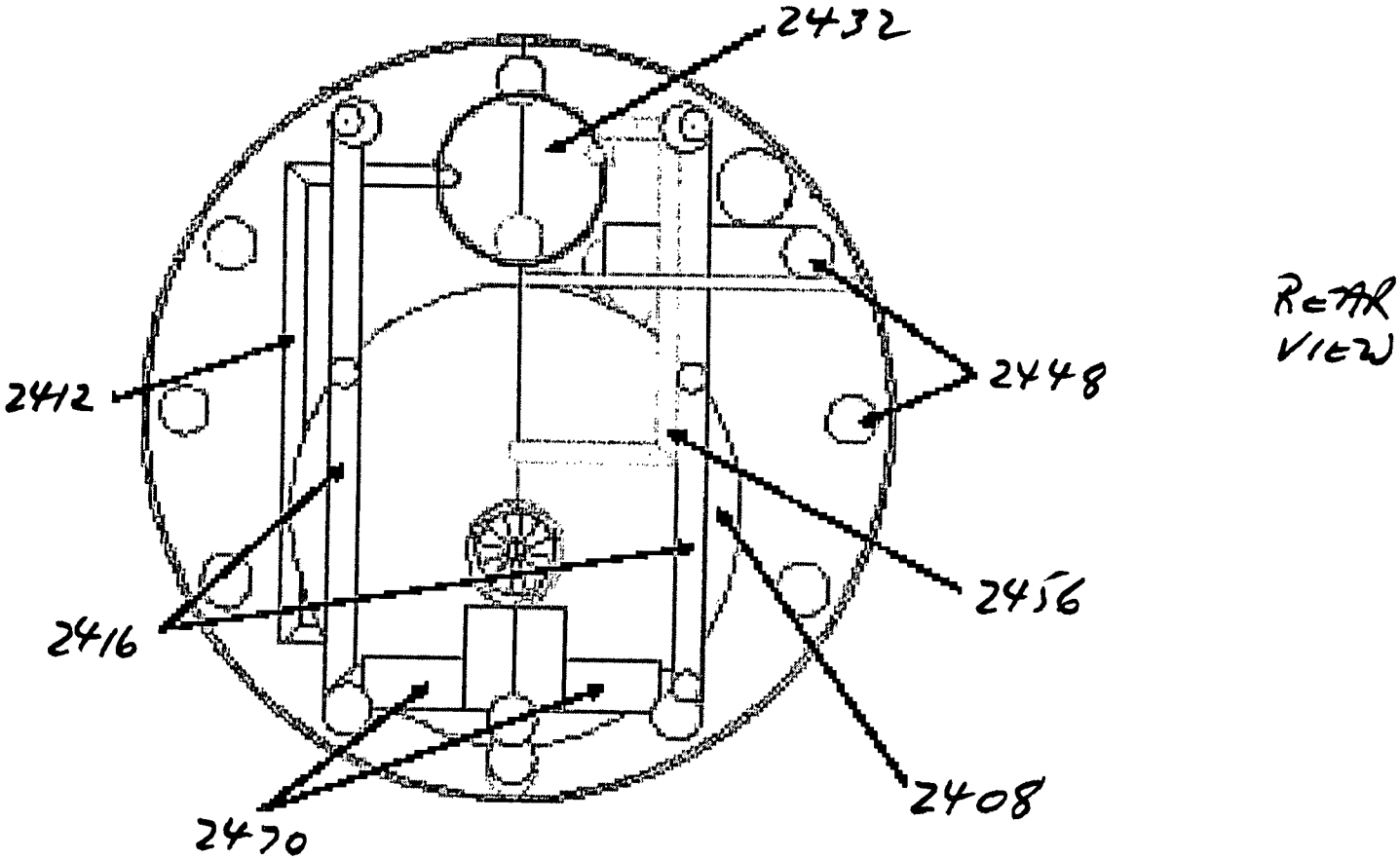
FIG. 18 shows a rear view of a TBM with an internal bitmin drum apparatus according to the embodiment of FIG. 11.
Figure 19:
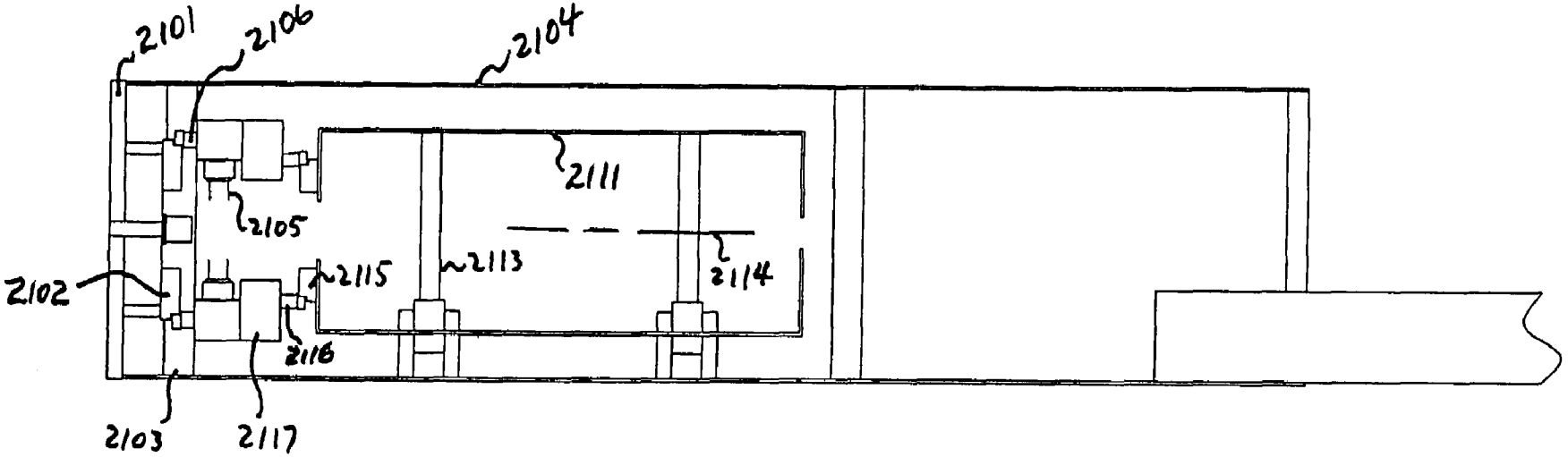
FIG. 19 shows a schematic side view of main cutter head and bitmin drum utilizing common TBM drive motors according to yet another embodiment of the present invention.

FIGS. 14 to 18 show various additional views of a bitmin drum in a TBM. These figures show a forward portion 2400 of a TBM including a cutter head 2404; bitmin drum 2408; lean froth (bitumen) discharge 2412 from the bitmin drum 2408 for outputting recovered bitumen; backfill discharge ports 2416 for waste material outputted by the bitmin drum 2408; work deck 2420 and liner erector 2424 for creating a liner 2428 for the trailing access tunnel 2432; the pressure chamber 2436 in communication with excavated material input ports in the cutter head 2404; cutterhead drive motors 2440; muck conveyor 2444 for transporting excavated material to the bitmin drum 2408; thrust cylinders 2448 and thrust bulkhead 2452 for advancing the TBM; water input line 2456 carried through the trailing access tunnel 2432 and into the bitmin drum 2408; waste material discharge output port 2416 from the bitmin drum 2408; or positive displacement pumps 2470 for emplacing the backfilled waste material 2460. FIG. 16 depicts the directions of flow of fresh water 2500, bitumen froth, and excavated material 2504, and waste material FIG. 19 shows a schematic side view of another embodiment of the present invention illustrating a method whereby the cutter head and bitmin drum can be rotated by a common array of motors. A cutter 2101 head is rotated by a large ring 2102 mounted in a bulkhead 2103. The bulkhead 2103 is attached to the main TBM shield 2104. The ring 2102 is driven by a series of hydraulic motors 2105 mounted around the bulkhead 2103. A plurality of such motors 2105 may be arranged, usually at equal intervals, around the bulkhead 2103. The motor 2105 turns a shaft 2106 which rotates the ring 2102. A bitmin drum 2111 is shown within the main TBM shield 2104. The bitmin drum 2111 is shown here mounted on roller bearings 2112, attached to the shield 2104 and which constrain the location of bitmin drum 2111 by two or more large rings 2113. The bitmin drum 2111 is rotated about its central axis 2114 by a large ring 2115 mounted on the front end of the bitmin drum 2111. The ring 2115 is driven by a second series of shafts 2116 which are in turn driven by the hydraulic motors 2105. The shafts 2116 are connected to the hydraulic motors 2105 through a commonly used mechanisms for transferring rotary motions from one shaft to another, rotary seals, reducing gears and clutch mechanisms, all which would be contained in housing 2117. Otherwise, the location of pressure bulkheads and articulated joints may be similar to that of the apparatus described in the preferred embodiment shown. in FIG. 13. Compared to the embodiment of FIG. 19, the embodiment of FIG. 13 has the advantage of the added operational flexibility of separate drive systems.

A number of variations and modifications of the invention can be used. It would be possible to provide for some features of the invention without providing others.

For example in one alternative embodiment, the shielded machine can have two or more rotating cutter heads. In that machine configuration, the machine may include a separate bitumen separation chamber operatively engaged with each rotating head. The bitumen separation chambers can be based on the Clark and/or CCDS processes.

In another embodiment, during operation of a TBM, the cutter head may be intermittently stopped and started and is usually designed to operate at different rotation speeds and its rotation direction can be reversed.

In yet another alternate embodiment, the TBM cutter can be stopped and the mixture of components of bitumen, water, sand and clay can be allowed to settle according to their specific gravities. The bitumen with associated gases will rise to the top and can be skimmed off in the form of a lean bitumen froth in the pressure chamber of the present invention. The heavier sand and clays will settle to the bottom and can be removed in part by scavenging devices such as for example a screw auger. In another embodiment, it may be preferable to utilize more than one pressure chamber. The rotation of these pressure chambers may be accomplished by connecting them to the drive systems that are used to rotate the TBM cutter head or they may have their own drive systems. By feeding the slurry through successive chambers, the recovery factor of bitumen can be increased.

In yet a further alternative embodiment, it is preferable to utilize more than one pressure chamber. The rotation of these pressure chambers may be accomplished by connecting them to the drive systems that are used to rotate the TBM cutter head or they may have their own drive systems. By feeding the slurry through successive chambers, the recovery factor of bitumen can be increased.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of excavating and processing hydrocarbon-containing materials, comprising:

excavating the hydrocarbon-containing materials with a rotating cutter head to form excavated hydrocarbon-containing materials; and separating a hydrocarbon-containing component from the excavated hydrocarbon- containing materials in an enclosed vessel, wherein, in a first mode, a surface of the enclosed vessel is operatively engaged with the cutter head, whereby the at least part of the enclosed vessel rotates in response to rotation of the cutter head and, in a second mode, the surface the enclosed vessel is operatively disengaged from the cutter head, whereby the enclosed vessel does not rotate in response to rotation of the cutter head.

2. The method of claim 1, wherein the hydrocarbon-containing materials comprise oil sands and wherein the hydrocarbon-containing component is bitumen.

3. The method of claim 1, wherein the surface of the enclosed vessel is one or more of a paddle, baffle, a blade, a raised surface of the cutter head, and a ridge on a surface of the enclosed vessel.

4. The method of claim 1, wherein the surface of the enclosed vessel comprises an end and sidewall of the vessel.

5. The method of claim 1, wherein the surface of the enclosed vessel rotates at the same speed as the cutter head.

6. The method of claim 1, wherein a gear causes the surface of the enclosed vessel to rotate at a speed different than the cutter head.

7. The method of claim 1, wherein, during the operatively disengaging step, the enclosed vessel remains stationary while the cutter head rotates.

8. The method of claim 1, wherein the cutter head is mounted on a tunnel boring machine and wherein the tunnel boring machine is located in an underground excavation.

9. A method of claim 1, wherein a pressure inside the enclosed vessel is superatmospheric.

10. The method of claim 1, wherein a pressure inside the enclosed vessel is at or near a formation pressure of an adjacent formation.

11. The method of claim 1, wherein the excavating step comprises:

passing the excavated hydrocarbon-containing materials through one or more openings in the cutter head and into the enclosed vessel and further comprising:

separating the hydrocarbon-containing component from a slurry in the enclosed vessel to form a waste material and the separated hydrocarbon-containing component;

hydrotransporting the hydrocarbon-containing component out of the underground excavation; and discharging the waste material behind the tunnel boring machine and in the underground excavation.

12. A method of excavating and processing hydrocarbon-containing materials, comprising:

(a) excavating the hydrocarbon-containing materials with a rotating cutter head to form excavated hydrocarbon-containing materials;

(b) locating the excavated hydrocarbon-containing materials in an enclosed vessel; and (c) while a first portion of the excavated hydrocarbon-containing materials is located in the enclosed vessel, rotating, during a first time interval, at least part of the enclosed vessel in response to rotation of the cutter head to separate a hydrocarbon- containing component from the excavated hydrocarbon-containing materials; and (d) while a second portion of the excavated hydrocarbon-containing materials is located in the enclosed vessel, not rotating, during a second time interval, the at least part of the enclosed vessel in response to rotation of the cutter head, wherein, in step (c), the at least a part of the enclosed vessel is engaged with the cutter head and, in step (d), the at least a part of the enclosed vessel is disengaged from the cutter head, wherein the at least part of the enclosed vessel is a surface of the vessel.

13. The method of claim 12, wherein the hydrocarbon-containing materials comprise oil sands and wherein the hydrocarbon-containing component is bitumen.

14. The method of claim 12, wherein the at least part of the enclosed vessel is one or more of a paddle, baffle, a blade, a raised surface of the cutter head, and a ridge on a surface of the enclosed vessel.

15. The method of claim 12, wherein the at least part of the enclosed vessel is comprises an end and sidewall of the vessel.

16. The method of claim 12, wherein the at least part of the enclosed vessel operatively engages and rotates at the same speed as the cutter head.

17. The method of claim 12, wherein a gear causes the at least part of the enclosed vessel to rotate at a speed different than the cutter head.

18. The method of claim 12, wherein disengaged from the cutter head, the enclosed vessel remains stationary while the cutter head rotates.

19. The method of claim 12, wherein the cutter head is mounted on a tunnel boring machine, wherein the tunnel boring machine is located in an underground excavation, and wherein a pressure inside the enclosed vessel is superatmospheric.

20. The method of claim 12, wherein the cutter head is mounted on a tunnel boring machine, wherein the tunnel boring machine is located in an underground excavation, and wherein a pressure inside the enclosed vessel is at or near a formation pressure of an adjacent formation.

21. The method of claim 12, wherein the excavating step comprises:

passing the excavated hydrocarbon-containing materials through one or more openings in the cutter head and into the enclosed vessel and further comprising:

separating the hydrocarbon-containing component from a slurry in the enclosed vessel to form a waste material and the separated hydrocarbon-containing component;

hydrotransporting the hydrocarbon-containing component out of the underground excavation; and discharging the waste material behind the tunnel boring machine and in the underground excavation.

22. A method, comprising:

(a) excavating, by a tunnel boring machine, a hydrocarbon-containing material, the tunnel boring machine comprising a rotating cutter head and an enclosed vessel in communication with at least a first input port in the cutter head, the at least a first input port being operable to receive material excavated by the cutter head;

(b) transporting the excavated hydrocarbon-containing material through the at least a first input port and into the enclosed vessel; and (c) rotating the enclosed vessel in response to rotation of the cutter head to separate a hydrocarbon-containing component from the excavated hydrocarbon-containing materials, wherein the enclosed vessel is a Counter Current De-Sanding (CCDS) drum comprising at least one second input port in the CCDS drum, wherein the excavated material is transported from the at least one first input port to the at least one second input port in the CCDS drum, and wherein the CCDS drum is contained within the tunnel boring machine.

23. The method of claim 22, wherein the CCDS drum comprises a first outlet for a bitumen rich stream and a second output for waste material and wherein the tunnel boring machine comprises at least one discharge port positioned behind the machine to discharge at least most of the waste material outputted by the CCDS drum.

24. The method of claim 22, further comprising:

passing a water stream through a heat exchanger to heat the water prior to input into the CCDS drum; and inputting the heated water into the CCDS drum, wherein the heat exchanger is in thermal communication with at least one thermal generating component of the tunnel boring machine.

25. The method of claim 22, wherein at least one common motor causes rotation of at least part of the CCDS drum and the cutter head.

26. The method of claim 22, further comprising:

(d) in a second mode, not rotating the enclosed vessel in response to rotation of the cutter head, wherein, in the first mode, a member of the enclosed vessel is engaged from the cutter head and wherein, in the second mode, the member is disengaged with the cutter head.

* * * * *